US010451388B1

(12) United States Patent
Podgorski

(10) Patent No.: US 10,451,388 B1
(45) Date of Patent: Oct. 22, 2019

(54) HIGH POWER MICROWAVE WEAPON

(71) Applicant: Andrew Stan Podgorski, Ottawa (CA)

(72) Inventor: Andrew Stan Podgorski, Ottawa (CA)

( * ) Notice: Subject to any disclaimer, the term of this patent is extended or adjusted under 35 U.S.C. 154(b) by 0 days.

(21) Appl. No.: 16/207,899

(22) Filed: Dec. 3, 2018

Related U.S. Application Data

(60) Division of application No. 15/165,261, filed on May 26, 2016, which is a continuation-in-part of application No. 14/151,561, filed on Jan. 9, 2014, now Pat. No. 10,149,923.

(51) Int. Cl.
*F41H 13/00* (2006.01)

(52) U.S. Cl.
CPC ..... *F41H 13/0068* (2013.01)

(58) Field of Classification Search
CPC ..... F41H 13/0068; H04B 1/7174; G01R 29/0821
See application file for complete search history.

(56) References Cited

U.S. PATENT DOCUMENTS 6,075,495 A * 6/2000 Podgorski ..... G01R 29/0821 343/776
7,342,534 B1 * 3/2008 Seddon ..... H04B 1/7174 333/139

FOREIGN PATENT DOCUMENTS

FR 2718228 A1 * 10/1995 ..... F41H 13/0068

OTHER PUBLICATIONS

A Tour of the Proposed National Ignition Facility, Energy and Technology Review, Dec. 1994 (Year: 1994).*
C.E. Baum et al., JOLT: A Highly Directive, Very Intensive, Impulse-Like Radiator, Proceedings of the IEEE, vol. 92(7), p. 1096-1109, 2004 (Year: 2004).*
C.E. Baum et al., JOLT: A Highly Directive, Very Intensive, Impulse-Like Radiator, Final Report, Air Force Research Laboratory, May 2006 (Year: 2006).*
V.V. Kladukhin et al., A High-Power Nanosecond Pulse Generator Based on Solid-State Switches, Instruments and Experimental Techniques, vol. 56(3), p. 294-298, 2013 (Year: 2013).*
(Continued)

*Primary Examiner* — Bernarr E Gregory
*Assistant Examiner* — Fred H Mull

(57) ABSTRACT

This invention allows combining broadband GW($10^{+9}$ Watt), peak power to achieve MV/m($10^{+6}$ Volt/meter), and GV/m($10^{+9}$ Volt/meter), radiated E-fields, in the range of air or vacuum breakdown in the entire electromagnetic spectrum, including optical frequencies and beyond. Use of many antennas and independently triggered generators allows achieving GV/m field, while by preventing the E-field induced breakdown it provides control of peak power and energy content at targets. The achieved broadband MV/m E-field levels and energy density significantly exceed levels required for destruction of distant electronic targets; therefore this invention radically improves the effectiveness of the electromagnetic weapons. Furthermore, collimating multiplicity of MV/m beams allows reaching GV/m E-field that exceeds by orders of magnitude the air or vacuum breakdown needed for broadband plasma excitation at resonance plasma frequencies in the 300 GHz range, permitting energy efficient plasma research leading to fusion.

16 Claims, 17 Drawing Sheets

(56) References Cited

OTHER PUBLICATIONS

A.S. Podgorski, Ultimate Broadband High Power Microwaves, American Electro-Magnetics Conference (AMEREM), Jul. 2014 (Year: 2014).*
A.S. Podgorski, The Quest for Ultimate Broadband High Power Microwaves, https://arxiv.org/abs/1411.6056, Nov. 2014 (Year: 2014).*
English Translation of FR 2718228 A1 (Year: 2019).*

* cited by examiner

HIGH POWER MICROWAVE WEAPON

CROSS REFERENCE TO RELATED APPLICATIONS

The present application is a divisional application of U.S. application Ser. No. 15/165,261, filed May 26, 2016, now allowed, which is a continuation-in-part of copending U.S. application Ser. No. 14/161,561, filed Jan. 22, 2014, now abandoned. The disclosure of this application is incorporated by reference herein in its entirety.

TECHNICAL FIELD

This invention generally relates to directed high power electromagnetic weaponry used to damage, disable, or render inoperable by transmitting electromagnetic radiation from a safe but effective distance which thereinafter is coupled into a wide range of target types. Although examples herein comprise on-the-axis Cassegrain antenna configurations and applications, this submission applies to off-the-axis Cassegrain antennas as well.

BACKGROUND OF THE INVENTION

Advanced non-conventional weaponry has been of increasing importance since Ronald Reagan called for an anti-missile defense system in 1983 and dubbed; "star wars." Among the potential components of the defense system were both space- and earth-based laser battle stations, which, by a combination of methods, would direct their killing beams toward moving Soviet targets. Critics pointed to the vast technological uncertainties of the system, in addition to its enormous cost. Although work was begun on the program, the technology proved to be too complex and much of the research was cancelled by later administrations. The idea of missile defense system would resurface later as the National Missile Defense.

A directed-energy weapon (DEW) emits focused or collective energy, transferring that energy to a target to damage it. In general, potential applications of DEW technology include anti-personnel weapon systems, potential missile defense system, and the disabling of airplanes, drones, and electronic devices such as mobile phones. The energy can come in various forms: electromagnetic radiation, including radio frequency, microwave, lasers and masers; particles with mass, in particle-beam weapons; and sonic weapons.

Ultra-wideband systems consisting of sources and antennas typically provide a radiated electromagnetic environment with a fairly flat spectral content over 1 to 2 decades (10's of MHz to several GHz). Such systems are finding many military and civilian applications, such as target identification, detection of buried targets such as leaky pipes and humanitarian de-mining, ISAR (Impulse Synthetic Aperture Radar) systems are also being considered for such applications as "seeing through walls". In providing transient energy to ultra-wideband antennas, many high-power transient sources (100's of kV in amplitude, 50-200 picosecond rise-times) that employ oil or gas spark-gap switches are designed and fabricated with coaxial or single-ended output geometry. In addition, solid-state transient sources are also commercially available with typically 50Ω coaxial cable output. A full reflector type of an impulse radiating antenna (IRA) requires a differential TEM feed to avoid common mode currents on the feed plates, which adversely impact the radiated pulse fidelity. Such systems are known to radiate impulse-like waveforms with rise-times Tr around 100 picoseconds (ps) and peak electric field values of 10's of kV/m.

Typical high power microwave (HPM) weapons are ineffective and unreliable, having electric fields less than 100 kV/m ($10^5$ Volts/meter) and GW ($10^9$ Watts) power pulses significantly longer than 1 nanosecond ($10^{-9}$ seconds).

For strategic applications targets such as missiles and satellites the high power microwave weapons rely on coupling energy to internal electronic components whereas high energy laser weapons rely of thermo-mechanical structural damage, primarily external.

The prevailing thought prior to this submission was that considering the constant relationship between energy, power and the E-field, wherein the probability of target damage can only be achieved by increasing a time of application of the electromagnetic field to distant targets. Incorrectly, it has been a generally accepted notion that to burn something we need to increase the time of radiation generation . . . everybody increases the pulse duration to their peril. This has led to huge impractical HPM weapon designs too costly to build, too heavy to ship, too large to fit, and too inefficient to power. It is clear that merely scaling up the radiation time interval or physical sizes is not the answer to increasing the probability of target damage.

The current most advanced weapon, C. Baum, JOLT, has the E-field×R=$6\times10^{+6}$ V (where R is non-diverging beam field-maximum-distance in meters) Baum's JOLT reflector antenna with a diameter of 3.6 m, results in R=86 m and a radiated E-field of 70 kV/m. It should be noted that the E-field* Rλ incorrectly imposes a notion that if this factor is large, one should be able to damage something, while in fact one could have a large diameter and a small E-field and be able to do nothing. This factor was promoted by Baum and his group to show how their reflector radiating only 70 kV/m is superior to everybody else. His and the others' systems could not burn protected equipment anyway as stated in the US Defense Science Board Task Force on Direct Energy Weapons, December 2007, Office of Under Secretary of Defense for Acquisition, Technology and Logistics, Washington D.C., the effectiveness (of JOLT) as a weapon has not been demonstrated with what can be mildly said, "it cannot burn anything".

Until now the electromagnetic power addition is done by using single frequency generator that through power splitter supplies low power signals to multiple high power amplifiers and delivers multiple high power beams to a target. This concept is still being used at all frequencies of the entire electromagnetic spectrum including microwave and optical frequencies. The most prominent applications of this concept in the area of electromagnetic fusion are the Tokomak in Europe and the National Ignition Facility (NIF) in the US. The use of single frequency, narrowband concept prevents Tokomak from generating and delivering sufficient power to reach a GV/m electric field in the range of 300 GHz that is corresponding to fusion plasma resonances. The NIF by using 192 collimated optical beams, each carrying power of tens of Watts, achieve GV/m electric field. However, at the optical frequencies the radiated power does not excite the fusion plasma resonances that occur at microwave frequencies. As such, the off-the-band high frequencies electromagnetic interactions does only "burn" the target without engaging the plasma molecular frequencies, making the excitation process energy inefficient.

To alleviate the Tokomak and NIF shortcomings in delivering electric field of required strength and frequency and to address the issue of energy efficiency this submission introduces new time domain power addition method and apparatus. Maximizing electric field, minimizing energy and separately or jointly addressing the molecular and thermal electromagnetic interaction that is addressed in this submission allows reaching GV/m electric fields at fusion plasma microwave resonance frequencies, increasing energy efficiency and the electromagnetic interaction probabilities. Maximizing the electric field to a level of GV/m in the vacuum and MV/m in the air, limited only by the breakdown in the propagation medium, allows using this invention as an ultimate High Power Microwave (HPM) weapon in the frequency range of 1 to 3 GHz and as fusion research facility in the 300 GHz frequency range.

In order to generate a GV/m E-field, required for HPM high energy physics research, power must be added first in the Cassegrain antenna and collimated (without divergence) so that a parallel uniform beam from the Cassegrain antenna can be focused into a single point. Learning from the high energy physics research, a Cassegrain antenna is identified and described herein as a serendipitous ideal weapon device component. However, for the Cassegrain antenna to be used as a component of a weapon it has to have a range of km and not the HPM research distance approximately 15 m. To achieve this range, the diameter of the radiated beam is disclosed herein as a specific range of sizes with a radiated E-field in the range of approximately 3-5 MV/m.

An exemplary research system was built in order to perform MV/m testing including a system of 2 generators with power supplies, 2 trigger generators with power supplies. The 2 trigger generators were triggered from the same trigger source to get synchronization. Each of the two generators was connected directly to an exemplary TEM-horn type antenna or horn. This set up is identical to an array of similar horns, with the horns at a close distance from each other resulting in de-coupling between the horns better than −30 dB. In the measurement setup, each beam was collimated using a spherical mirror and sequentially each beam was focused into a single point. The adjustment of timing was demonstrated in part by moving the position of one antenna in respect to the other. Using an alternative calibration technique the distance of each of the generator in respect to the horn in the array has to be varied using phase shifters including for example, sliding high voltage cables for each beam in order to calibrate the timing of the entire Cassegrain antenna at the target.

It was obvious to the applicant that the TEM-horns as patented previously will not radiate MV/m E-field required by this invention. Simply the wedges needed previously to separate the vertical and horizontal illumination as well as dielectric lenses, low surface breakdown voltage and low dielectric breakdown voltage did not allow increasing the E-field at least 10 times as needed. A new HPM TEM-horn had to be invented in order to allow broadband operation at microwave frequencies (within 1 to 500 GHz range) and at MV/m field level. It is easily verifiable that antennas of the HPM TEM-horn capabilities did not exist till now.

A need has existed for an HPM TEM-horn that permits applying from a single generator voltage of 20 MV without resulting in breakdown. The advancements and improvements herein make this HPM TEM-horn the first and only microwave antenna in the world that presently can operate at power level of 2 TW ($2*10^{+12}$ W) into a 100 ohm antenna input.

BRIEF DESCRIPTION OF THE INVENTION

Some or all of the above insights, needs, problems, and limitations may be addressed by the invention as summarized as follows:

Absorption and dispersion of electromagnetic energy is analyzed by regarding free electrons in an atom as damped oscillators. With the use of Einstein's coefficients, this classical approach is expanded to include a quantum behavior. A damped oscillator approach implemented in this invention applies to the entire electromagnetic spectrum extending from microwave frequency of 1 GHz to optical frequencies, however current manufacturing technology required to assemble the apparatus of this invention limits the maximum frequency to 500 GHz. It should be understood that at low frequencies of 1 to 10 GHz the oscillations occur inside and outside metallic boxes and along cables and wires substituting for the atomic damped oscillator approach.

Two types of interactions are included in this submission i.e. a thermal and a strong field enhanced interaction. Out of these two, the thermal interaction requires more energy since the entire object that is to be affected has to reach a temperature identical with a surrounding. The strong field enhanced interaction increases only the temperature of a small part of an object and therefore it requires less energy. To decrease the radiated energy it is paramount to use the strong electric field enhanced interaction that is being done by increasing the radiated power.

The present invention provides a method of generating a high power microwave beam of radiation efficiently and at power levels never before achieved while keeping the E-field safely below the ionization threshold levels. This, with the ability of configuring an array of HPM TEM-horns in various arrays or banks. A firing sequence of the arrays or banks optimizes power generation by transmitting multiple primary generator pulses ($T \approx 1$ ns) separated by time spacing $T*Q$ wherein Q is the quality factor of a target resonance response to a radiation coupling event and their sum $(T+T*Q)$ is assigned as a primary interval, Tint. The generator pulses are associated with triggers of corresponding banks of generators resulting in power pulses through associated arrays of the HPM TEM-horns. The generator pulse time T and rise-time (Tr) are further associated and determined to comprehend a coupling band encompassing a minimum frequency (fmin) and a maximum frequency (fmax) of a target to establish a likelihood of at least one form of damage to the target.

The present invention provides a weapon system comprised of components working in a harmonized and efficient manner including a control unit which performs human interface, security, calculations, target assessment and acquisition, phasing, and fire control. The weapon system is further comprised of components including a power supply, triggering devices, phase control/calibration for simultaneous firing of a plurality of HPM TEM-horns, generators which power 1 or more HPM TEM-horns, an array of TEM-horns, a Barlow Lens set, and a properly sized Cassegrain Antenna.

The present invention provides an optimized facilitation of a radiation source of the HPM weapon system whereby the parameters associated with the optimized high power generation and transmission are synergistic with practical physical sizes which are important for transportability required by any weapons system and cost control;

a. Radiating high power microwave generator pulses T of no more than approximately 1 nanoseconds (ns) in duration: this decreases ionization potential (since it takes additional time to result in ionization) allowing increased radiated power at a minimum frequency of 1

GHz (fmin=1/T) and allows the diameter of a transmitting Cassegrain antenna primary reflector to be 9 meters or less, b. with a pulse rise time (Tr) at least six times shorter than the 1 ns generator pulse duration or 0.17 ns: this limits the maximum frequency [fmax=1/(2*Tr)], and c. reducing the size of all components of the power delivery system of this invention.

Furthermore, the invention teaches how to increase radiated power and energy without increasing the energy from the generators by inserting and dividing a target oscillation time, Tosc, into multiple primary generator pulses T, for individual generators, sub-groups, or banks of generators in an array, with time spacing T*Q between the generator pulses T comprising primary intervals until all the available generators or generators intended for use of the generator array have fired.

Furthermore, the invention teaches a new operational and design property of a Cassegrain antenna applicable only to broadband defined herein as fmax/fmin>3 operation which assures smooth pulse amplitude through the near simultaneous superposition of radiated pulses for an approximately maximal combined amplitude.

The improved and advanced power HPM TEM-horns of this invention are superior to all previous TEM-horns. The previous TEM-horn's 350 kV limited operation has been increased to 4 MV (≈10× increase in breakdown voltage) at 1-5 GHz as one of the advancements or improvements comprising the HPM TEM-horn of this invention.

Furthermore, the invention teaches an improved and advanced HPM TEM-horn design including an ability to radiate MV/m E-field and broadband operation at microwave frequencies (1 to 500 GHz) at MV/m field level.

Furthermore, the invention teaches the use of a central frequency (fc) within the fmin to fmax range fc=√(fmin× fmax) making it possible to operate efficiently with optimized dimensions of HPM TEM-horns of a specific improved and advanced design in conjunction with the Cassegrain antenna to support frequencies from 1 GHz to 500 GHz bringing into range atomic responses.

For the first time, this invention allows matching of the spectral components of the generated signals with the transfer function defining the strongest electromagnetic coupling assuring the most efficient field induced effects and at field levels never achieved before, and at the most important frequencies of molecular and atomic interactions identified currently and any time prior to now using spectroscopic means.

For the first time use of microwave MV/m and GV/m fields should allow looking into non-linear atomic interactions that current optical methods, by being at far away molecular interaction frequency, could only induce in an indirect way This summary has been outlined rather broadly including the more important features of the invention so that a detailed description thereof that follows may be better understood, and so that the present contribution to the art may be better appreciated.

BRIEF DESCRIPTION OF THE DRAWINGS

The foregoing, and other aspects, and embodiments will be better understood from the following detailed description of the exemplary embodiments of the invention with reference to the drawings, in which.

DETAILED DESCRIPTION

Example embodiments of the invention now will be described more fully hereinafter with reference to the accompanying and incorporated by reference (cross-referenced) drawings, in which embodiments of the invention are shown. This invention may, however, be embodied in many different step sequences, forms, structures, or materials and should not be construed as limited to the embodiments set forth herein. Rather, these embodiments are provided so that this disclosure will be thorough and complete, and will fully convey the scope of the invention to those skilled in the art.

Like identified numbers refer to like elements throughout. The use of asterisks herein is indicative of multiplication operations unless otherwise noted.

It should be noted that, as used in the specification and the appended claims, the singular forms "a" and "the" include plural referents, unless the context clearly dictates otherwise. Thus, for example, reference to an array can include reference to one or more of such arrays.

Figure 1A:
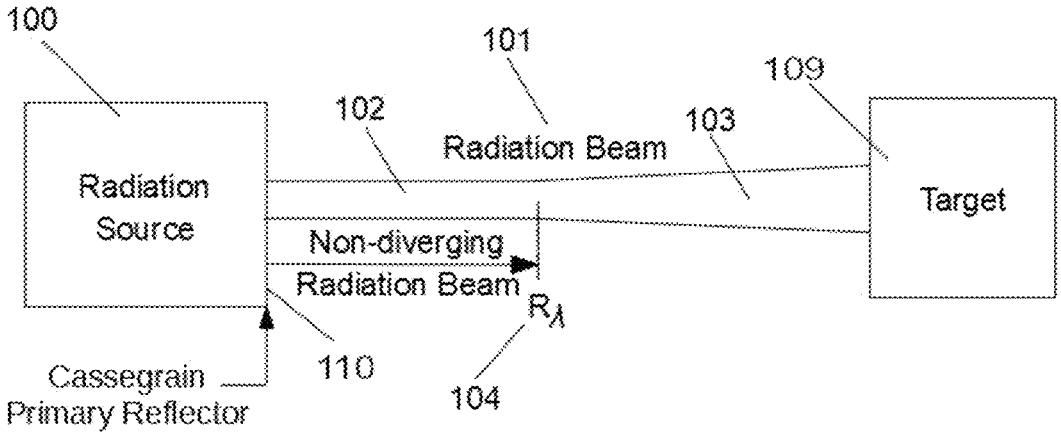
FIG. 1A is a block diagram of an exemplary weapon system including a radiation source, a radiation, and a target.

With reference to FIG. 1A, a flow diagram illustrates an exemplary engaged high powered microwave (HPM) weapon system including a radiation source 100, a radiation beam 101 emitted by radiation source 100, and an engaged, radiated, or illuminated target 109.

Figure 1B:
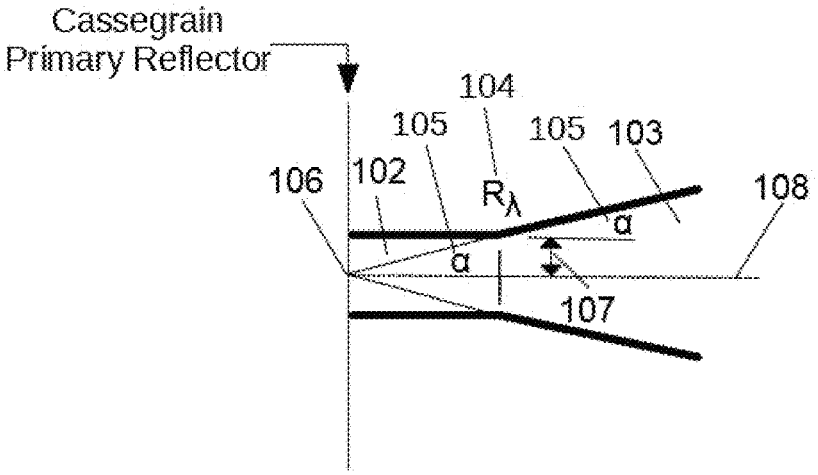
FIG. 1B is a detailed section view of a radiation beam showing a non-diverging section and a diverging section according to a divergence angle α.

FIG. 1A shows a composite beam 101 coming from the radiation source's Cassegrain primary (large) reflector. The radiation beam is shown in two sections 102 and 103. The first section 102 of the radiation beam extends to a distance equivalent to 104, $R_\lambda$ disclosed herein as a non-diverging beam. The second radiation beam 103 begins at the distal end of the non-diverging beam 102 and extends outward in a diverging angle 105, α as shown in FIG. 1B.

The target is shown in FIG. 1A beyond the position of radiation beam divergence 104, $R_\lambda$, but could be located and illuminated at various positions in the beam and subject to damage up to a maximum distance based on various power and energy factors disclosed herein.

With continuing reference to FIG. 1A, regarding Cassegrain antennas with insufficiently sized primary and secondary diameters, beyond a limit there will not be enough beam forming strength resulting in a spill over the main reflector diameter. A diameter limit wherein the beam shape degrades is $D_\lambda>50$ wherein the primary reflector $D_\lambda \approx 115/\sqrt{\pi}$ expressed in wavelength λ.

With continuing reference to FIG. 1A, the radiated power in a non-diverging beam section 102 starting from a primary reflector 110 in a Cassegrain antenna does not decrease until the distance traveled is equal to 104, $R_\lambda$. After that distance the beam section 103 is diverging as it would in any other dish antenna. From the electronic warfare point of view it is important how big the E-field is and what the distance is of 104, $R_\lambda$ from a target. $R_\lambda$ can be defined as a field-maximum-distance factor equal to E-field*$R_\lambda$. The higher the E-field*$R_\lambda$, the greater the effectiveness of the weapon. The E-field*$R_\lambda$, when calculated at the central frequency of the band fc, allows an equitable power/distance comparison of all electromagnetic weapons.

With continuing reference to FIG. 1A, for all reflector antennas at a distance of 110, 0 m from the reflector, and extending to 104, $R_\lambda$, the radiated E-field is constant, therefore one should look at the E-field*$R_\lambda$ quantity as a maximum distance of a maximum radiated E-field, if there are no losses in the propagation medium.

With reference to FIG. 1B, the radiation beam is shown with visually shortened non-diverging section 102 and diverging section 103 so that the divergent angle 105, α, can be ascertained. The divergent angle 105, α, is the arctangent of the non-diverging beam radius 107 divided by $R_\lambda$ 104. The radiation beam radius equals the primary reflector radius of the Cassegrain antenna.

With continuing reference to FIG. 1B, the vertex 106 of the divergence is located at the primary reflector surface 110 of the Cassegrain antenna. The center of the radiation beam sections 102 and 103 is shown as a dashed line 108.

The distance 104, $R_\lambda$, defines only the beam non-diverging distance and in a sense this distance is defined by the radiation losses associated with the Cassegrain antenna and therefore the Cassegrain antenna should not have diameter smaller than 50 wavelengths since the divergence losses in the beam will exceed 20% based on diameter based on this limitation.

For the best performance of the Cassegrain HPM TEM-horn array that has angular amplification of approximately 10, the power density and the distance of the target from the antenna have to be optimized. At a maximum preferable distance, i.e. at the end of the non-diverging beam region 104, a target and antenna diameter are equal $D_t=D_a=D$, and the maximum number of HPM TEM-horns, $N_{opt}$, is defined by the diameter of the primary reflector $$D_\lambda \approx \frac{115}{\sqrt{\pi}},$$

expressed in wavelength A corresponding to the "central" frequency fc of the band.

$$N_{opt} \lessapprox \frac{\pi}{350} D_\lambda^2$$

The maximum distance at the end of the non-diverging beam of the target position R is optimized and as a function of antenna diameter $D_\lambda$ expressed in wavelength λ corresponding to the "central" frequency fc of the band.

$$R_\lambda \le R_{\lambda opt} \approx \frac{\sqrt{\pi}}{2} D_\lambda^2$$

Figure 2A:
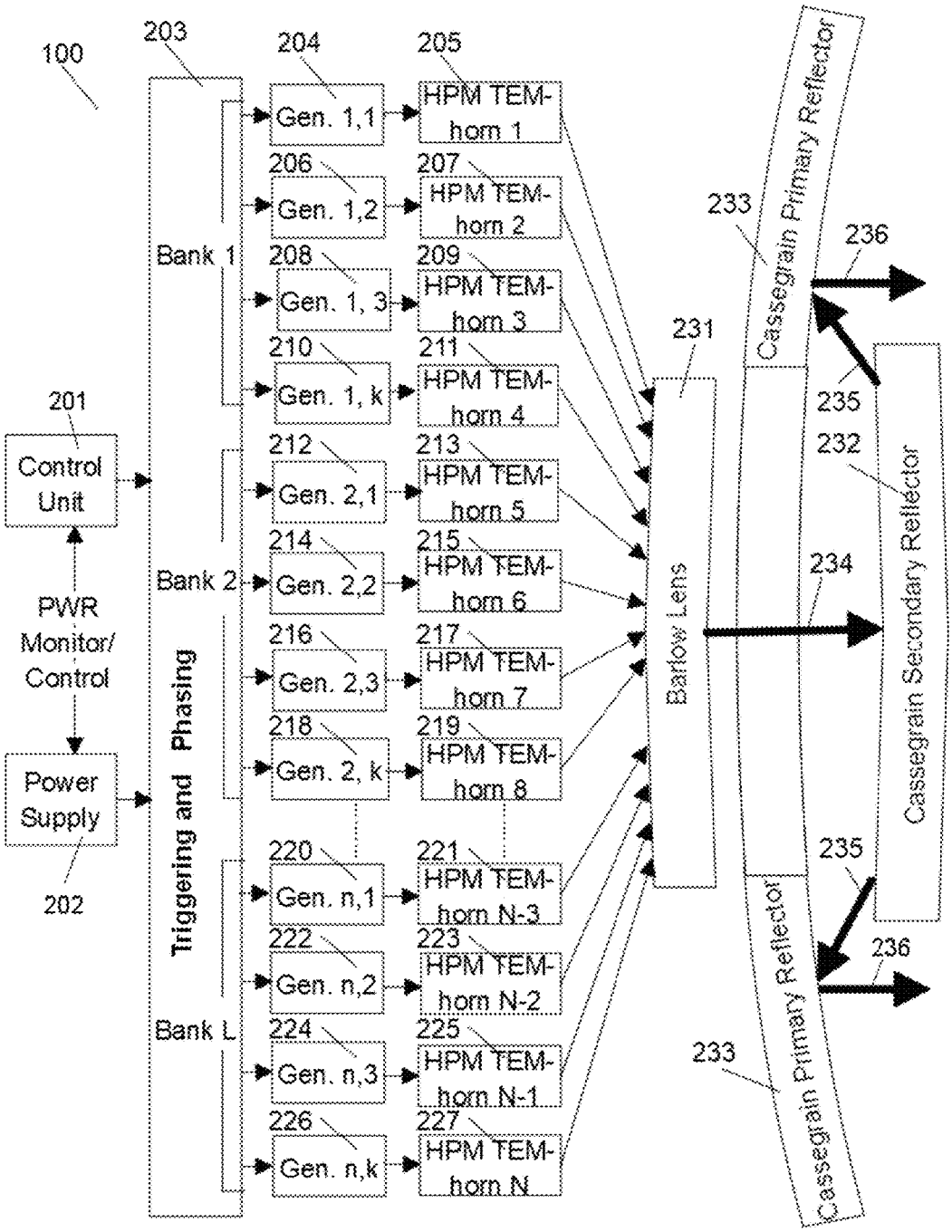
FIG. 2A is a block diagram of an exemplary HPM power source including a control unit, power supply, triggering and phasing section, generator banks, HPM TEM-horns, optional lens set, and a Cassegrain antenna.

With reference to FIG. 2A, a plurality of exemplary components of a radiation source 100 are shown with indications of associated interconnection and a general direction and control by a control unit 201 of radiation creation and pathways of radiation flow to a final launch surface. A power source 202 provides power to a triggering and phasing section 203 which triggers "L" banks of generators starting with bank 1; 204, 206, 208, 210 continuing with bank 2; 212, 214, 216, 218 and concluding with bank "L"; 220, 222, 224, 226 as controlled by the control unit 201. It is noted that there may be as few as no banks of generators with independent generator control by the control unit 201 of individual generators and therefore independent operation.

The exemplary configuration of FIG. 2A shows "k" generators per bank or sub-grouping of generators, or k=4 in this example configuration.

With continuing reference to FIG. 2A, calibrated phasing or relative timing controlled by the triggering and phasing section 203 assures that each member generator of a bank of generators fires simultaneously upon a bank fire command from the control unit 201.

With continuing reference to FIG. 2A, an exemplary array of "N" HPM TEM-horns; 205, 207, 209, 211, 213, 215, 217, 219, 221, 223, 225, 227 are configured in physical arrangements to optimize the effective contribution of each HPM TEM-horn in the context of the overall collimated radiation beam 236 being constructed. Although not shown in FIG. 2A, any exemplary HPM TEM-horn can be powered by one or a plurality of HPM generators, typically one generator per each septum of the HPM TEM-horn.

With continuing reference to FIG. 2A, the radiations from the exemplary "N" HPM TEM-horns pass through the exemplary Barlow lens or lens set 231 and after passing through a central opening in an on-the-axis Cassegrain antenna's primary reflector 233 to illuminate 234 the Cassegrain antenna's secondary reflector 232 which reflects the collective radiation 235 and illuminates the Cassegrain antenna's primary reflector 233 which in turn launches the radiation 236. It should be understood that the depiction of radiations 234, 235, and 236 are not intended to represent the actual shape or distribution of the radiation, but to indicate the basic motions of the radiations between the components and apparati associated with the Cassegrain antenna. Furthermore, the orientations of the HPM TEM-horns are optionally flat or concave face assembly as facing the Cassegrain secondary reflector.

Figure 2B:
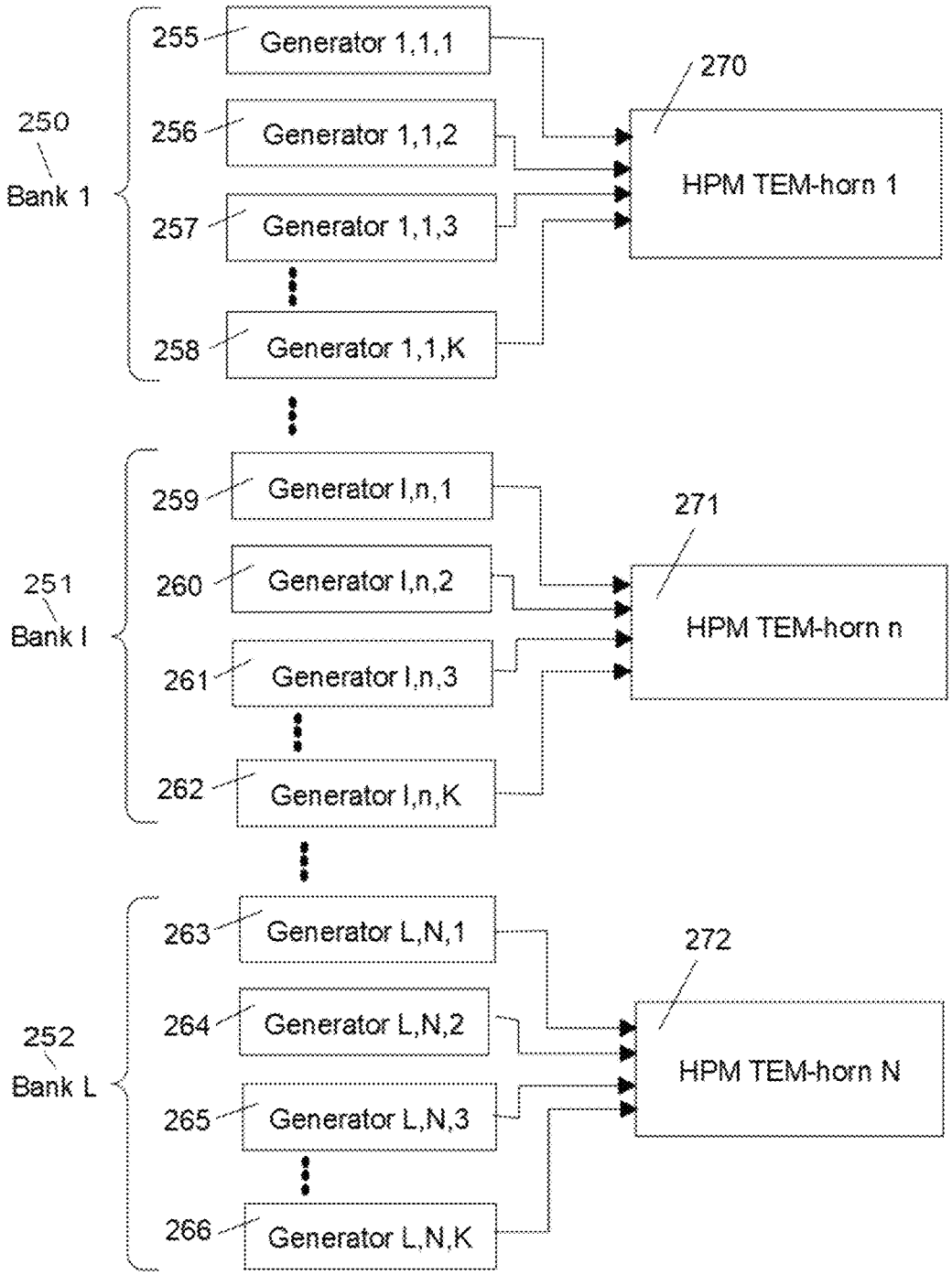
FIG. 2B is block diagram of combinations of generators and HPM TEM-horns and associated indexing and designations of an exemplary configuration of same.

With reference to FIG. 2B, a block diagram shows exemplary generators to HPM TEM-horn configurations 250, 251, and 252 in the context of a plurality of L banks of generators, K generators per bank of generators, and N HPM TEM-horns. The generator indexes are assigned l,n,k corresponding to l assigned to bank number of L total banks, n assigned to HPM TEM-horn number of N total HPM TEM-horns, and k assigned to a generator number within a given bank of K generators.

With continuing reference to FIG. 2B, the first bank shown 250 or Bank 1 generators wherein generator 1,1,1 255 through 1,1,K; 256, 257, 258 are assigned as bank 1 powering HPM TEM-horn 1 270. The second bank shown 251 or Bank 1 generators wherein generator 1,n,1 259 through 1,n,K; 260, 261, 262 are assigned as bank 1 powering HPM TEM-horn n 271. The third bank shown 252 or Bank L generators wherein generator L,N,1 263 through L,N,K; 264, 265, 266 are assigned as bank L powering HPM TEM-horn 1 272. The exemplary HPM TEM-horns 270, 271, and 272 are shown with four generator inputs each but it is understood that HPM TEM-horns in general may be powered by one, two, four, or more generators wherein the HPM TEM-horns of the invention may have embodiments including one, two, four, or more than four septums, each powered by one or more generators.

With reference to FIG. 3A, FIG. 3B, FIG. 3C, and FIG. 3D; the exemplary improved and advanced HPM TEM-horn embodiments 300, 306, 310, and 350 of this invention are significantly improved and enhanced over all previous broadband antennas including TEM-horn and microwave antennas.

The present invention provides a method, system, and apparatus for generating a high power microwave beam of radiation efficiently and at power levels never before achieved while keeping the E-field safely below the ionization threshold levels. To accomplish this, the use of improved and advanced power HPM TEM-horns of this invention is required.

The improved and advanced power HPM TEM-horns of this invention are superior to all previous TEM-horns. The previous TEM-horn's 350 kV limited operation has been increased to 4 MV (≈10× increase in breakdown voltage) at 1-5 GHz as one of the advancements or improvements comprising the HPM TEM-horn of this invention.

Furthermore, the invention teaches an improved and advanced HPM TEM-horn design including an ability to radiate MV/m E-field and broadband operation at microwave frequencies (1 to 500 GHz) at MV/m field level.

The improved and advanced HPM TEM-horns of specific component sizes, shapes, and materials herein including dielectric material and distributions in the HPM TEM-horn provide capability of operation in the 10 to 50 GHz frequency range or band with an air breakdown limit in the range of 70 MV/m in this frequency band.

Figure 3A:
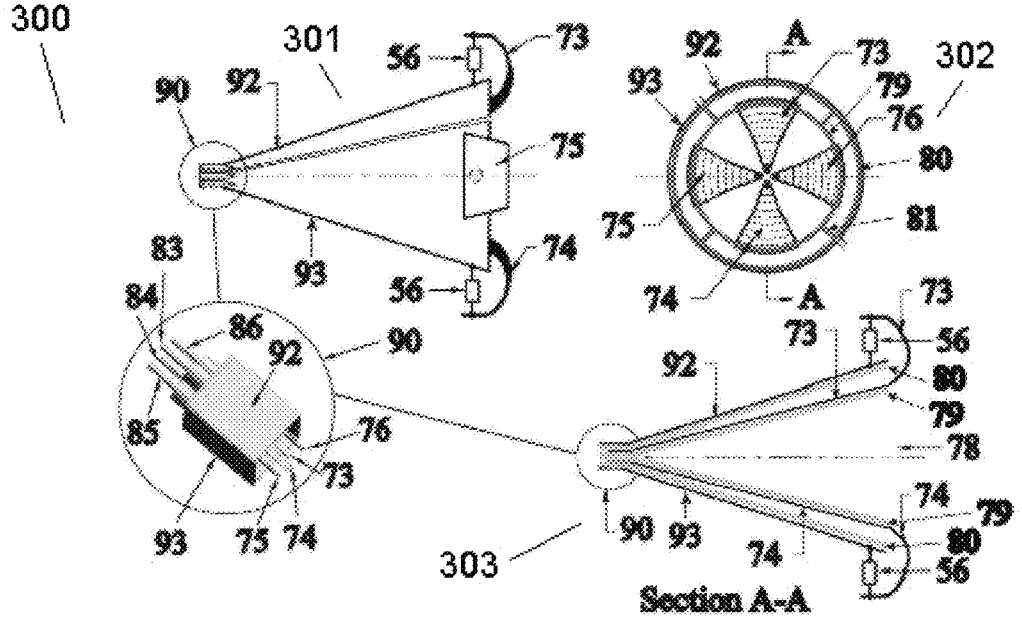
FIG. 3A shows three 2D views of the broadband, conical, double-polarization, multi-septum HPM TEM-horns along with a perspective view of an optional straight-through portal connection.
Figure 3B:
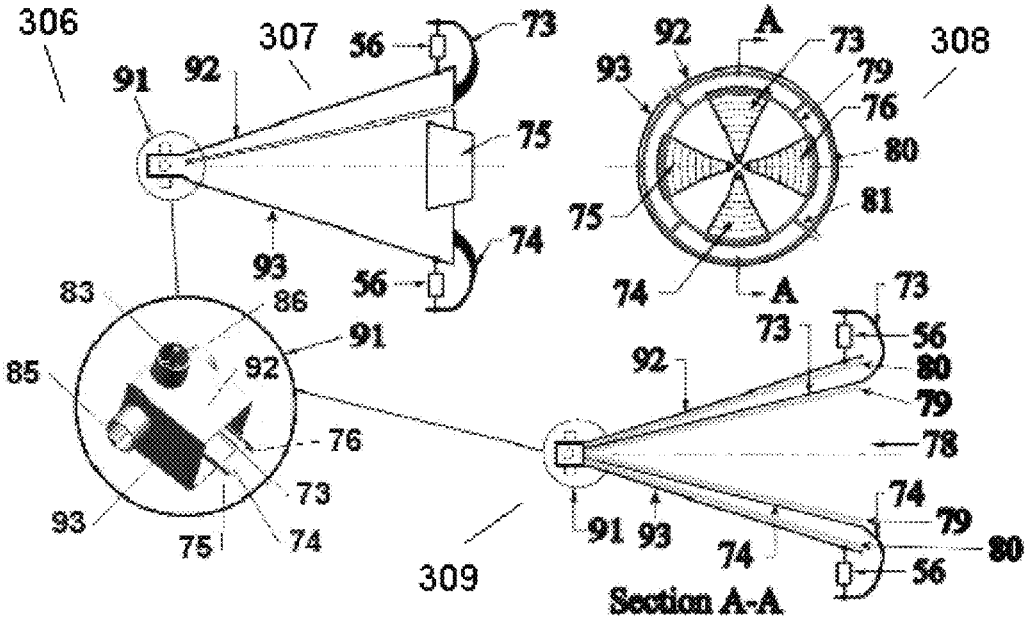
FIG. 3B shows three 2D views of the broadband, conical, double-polarization, multi-septum HPM TEM-horns along with a perspective view of a preferred right angle coaxial portal connection.

The HPM TEM-horns of the invention herein may have embodiments including enclosure shapes including rectangular, round, or other shapes as viewed relative to the output or mouth end 78 shown in FIG. 3A and FIG. 3B.

Terminating the septums within a range of 50 to 200 ohms, typically 100 ohms, is expected depending on the configuration and application of the HPM TEM-horn, and one or more terminating resistors having a total or equivalent resistance equal to the wave impedance of the septum are needed. In order to provide HPM TEM-horn impedance matching, between the generator and free space where the power is being radiated, along the entire length of the horn, the input impedance, the septum wave impedance, and the terminating resistance values have to be identical.

All broadband antennas including HPM TEM-horn, TEM-horn, and microwave antennas are designed to have input impedance between the septum and one or more horn enclosure containments in the range of 50 to 200 ohms depending on the configuration of the particular antenna. The maximum resistance value of 200 ohms differs from the maximum theoretical value of 377 ohms that corresponds to the wave impedance of a free space. It is an important design consideration that, increasing the value of impedance above 200 ohms, could result in an unacceptable loss of antenna efficiency.

With reference to FIG. 3A, several views 300 of an exemplary round bodied, 4-septum embodiment of an HPM TEM-horn with a straight-through quad port are shown. Three 2D views; 301, 302, and 303 of the broadband, conical, double-polarization, multi-septum HPM TEM-horns are shown in FIG. 3A along with a perspective view of a straight-through portal connection 90. Views 301, 302, and 303 show vertical polarization septums with terminated extensions 73 and 74 and horizontal polarization septums with terminated extensions 75 and 76. The terminations 56 shown in views 301 and 303 are resistive in the form of resistors with values that match characteristic impedance of each associated septum referenced to the HPM TEM-horn enclosure sections 92 and 93 as shown with septums 73 and 76 terminations to enclosure section 92 and septum 74 and 75 terminations to enclosure section 93. The four terminating resistors 56 of this invention are preferably 100 ohms.

With continuing reference to FIG. 3A, the exemplary embodiment 300 shows four straight through antenna inputs 83, 84, 85, and 86 shown in view 90 that allows connecting four or less separate generators, resulting in increasing the output power four times over an antenna with a single septum. It is also possible to power more than one septum per generator.

With continuing reference to FIG. 3A, views 302 and 303 show the locations of solid dielectric or insulation 79 inside and adjacent to the septums and 80 inside and adjacent to the enclosure walls 92 and 93. The solid dielectric is preferably approximately 12 mm in thickness and of sufficient rigidity to hold a conical or other shapes as used depending on the HPM TEM-horn shape.

With reference to FIG. 3B, several views 306 of an exemplary round bodied, 4-septum embodiment of an HPM TEM-horn with a coaxial quad port. Three 2D views; 307, 308, and 309 of the broadband, conical, double-polarization, multi-septum HPM TEM-horns are shown in FIG. 3B along with a perspective view of a coaxial portal connection 91. Views 307, 308, and 309 show vertical polarization septums with terminated extensions 73 and 74 and horizontal polarization septums with terminated extensions 75 and 76. The terminations 56 shown in views 307 and 309 are resistive in the form of resistors with values that match characteristic impedance of each associated septum referenced to the HPM TEM-horn enclosure sections 92 and 93 as shown with septums 73 and 76 terminations to enclosure section 92 and septum 74 and 75 terminations to enclosure section 93. The four terminating resistors 56 of this invention are preferably 100 ohms.

With continuing reference to FIG. 3B, the exemplary embodiment 306 shows four coaxial right-angled antenna inputs 83, 84, 85, and 86 shown in view 91 that allows connecting four or less separate generators, resulting in increasing the output power four times over an antenna with a single septum.

With continuing reference to FIG. 3B, views 308 and 309 show the locations of solid dielectric or insulation 79 inside and adjacent to the septums and 80 inside and adjacent to the enclosure walls 92 and 93.

A multi-port HPM TEM-horn configuration and design improvement comprises a two part enclosure 92 and 93 as shown in FIG. 3B configured to expand the bandwidth by four times in respect to bandwidth of identical antenna having undivided enclosure.

Two port HPM TEM-horns each have two inputs/outputs in respect to the ground as shown in FIG. 3B one of which is + the other −. Therefore when measuring output voltage between + and − the result is a measured voltage that is twice as high as a voltage at a single port. When supplying power into the antenna we will get double radiated power. Input port 84 and 85 are "−" and port 83 and 86 "+" or vice versa for +/−. When port 83 is connected to + of the generator the − of the generator is connected to the enclosure 92. Input port 84 is not visible in FIG. 3B. It is only visible in FIG. 3A. The ports that are connected to the septums under the same enclosure section should have the same sign. Looking at septum 73 (connector port 83) and 76 (connector port 86), these are under the same section of enclosure 92, while septums 74 (connector port 84) and 75 (connector port 85) are under the same section of enclosure 93.

The four port HPM TEM-horn design as shown in FIG. 3B, includes two + ports and two − ports. In an optional receive mode the HPM TEM-horn has two double voltage outputs that are E-field polarization dependent. When working as a transmitter the HPM TEM-horn uses 4 inputs (two double power inputs) that radiate power that is 4 times higher than the previous single generator/single TEM-horn antenna system.

A Cassegrain type antenna array populated with the 4-septum HPM TEM-horn of FIG. 3B, verses single septum antennas, is preferred with 2× radiated E-field increases and increased high voltage durability of this invention apparatus operating at one-fourth of the generator power applied to each of the four septums with a combined power equivalent to that of a single septum antenna operating at full power.

Figure 3C:
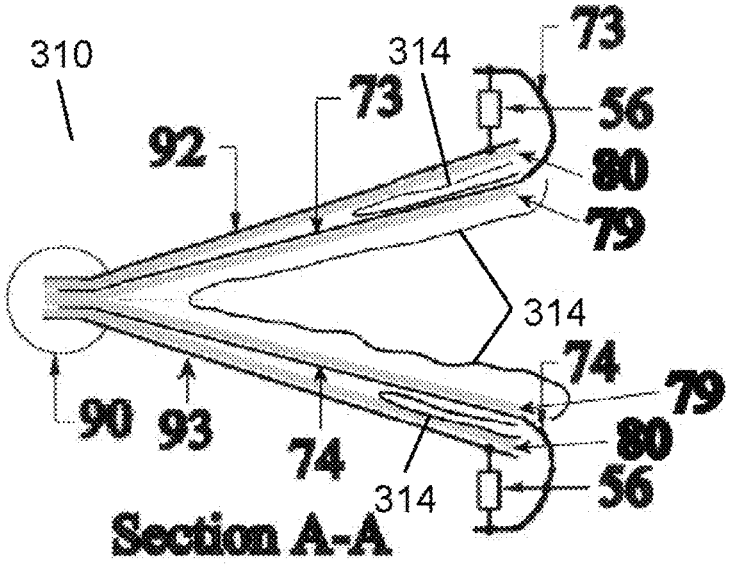
FIG. 3C is a cross-sectional view of a single septum HPM TEM-horn showing potential voltage breakdown sections and mitigating dielectric distributions associated with the septum and enclosure inside wall surfaces.

With reference to FIG. 3C, a partial cross-sectional view 310 of an exemplary dual (or quad with only two septums shown at the cross-sectional view) septum HPM TEM-horn is shown to further understand distinctions and improvements of the HPM TEM-horn over prior antennas and how these and other alternative improvements are included for optimized or proper performance of the invention. The aspects of the dual septum 73 and 74 embodiment 310 regarding solid dielectric layers 79 and 80 or breakdowns due to ionization 314 are transferrable directly to multi-septum HPM TEM-horns having 4 or more septums.

With continuing reference to FIG. 3C, the improved and advanced HPM TEM-horn design supports increased voltage (compared with the previous 350 kV TEM-horn) operation to 4 MV at 1 to 5 GHz to avoid voltage breakdowns 314, required the use of a solid insulating material or dielectric 79 inside and adjacent to septums 73 and 74 and the use of dielectric 80 for insulating the inside surface of the enclosure wall 92 and 93. Increasing the breakdown voltage is accomplished by the dielectric placement as shown in FIG. 3C, but can decrease the maximum frequency of operation of the antenna. Therefore, the breakdown voltage improvements using solid insulating material or dielectric are done using a technique and a material specifically to optimize the maximum frequency of operation. The dielectric material, polytetrafluoroethylene (PTFE), was chosen comprising an approximately constant thickness throughout the septum 79 or the inside of the enclosure 80.

The preferred material for the septums is brass with a thin coating of PTFE affixed thereto which provides the first level of protection against voltage breakdown or breakdown. The solid insulating material or dielectric, preferably PTFE, is the second level of protection against breakdown. The combination of the PTFE coating and solid PTFE members of the HPM TEM-horn provide the horn with remarkably non-linear increases in breakdown voltage.

With continuing reference to FIG. 3C, various dimensional aspects of the exemplary HPM TEM-horn are disclosed herein. In the field of high power microwave design, the associated devices and components comprising the HPM TEM-horn are dependent upon size, shape, and separations for performance. Furthermore, the dimensionality of said size, shape, and separations are quantified as follows.

For 10 GHz to 50 GHz operation, the air breakdown is in the range of 70 MV/m in this band. The input peak voltage at the portals of the HPM TEM-horn at 90 in FIG. 3C is 350 kV, therefore a 5 mm gap in the air is sufficient to prevent breakdown. The gap in the exemplary HPM TEM-horn design is 5 mm at a position where the solid dielectric ends at 90; 160 mm from the beginning of the horn. The thickness of PTFE coating the septum is 100 or 200 micrometers resulting in a non-linear effective thickness corresponding to approximately 2 mm of solid PTFE. The thickness of solid PTFE adjacent to the septum is 1.15 mm, therefore the total equivalent solid PTFE insulation thickness is 3.15 mm which can withstand a 1 MV 100 ps pulse duration. Considering that the entire horn is 400 mm long and PTFE solid dielectric is 160 mm long, the solid PTFE covers 40% of the horn length. The thickness of the solid PTFE is decreasing very little when one moves away from the beginning of the horn. The PTFE coating on the septum has a thickness of 100 or 200 micrometers everywhere. The horn enclosure is made out of solid aluminum to be sturdy and the septum out of brass. The septum begins at a location located at 40 mm from the bottom of the horn. Septum is a square rod 1.3 mm at the beginning and in a length of 100 mm expands to 3 mm width and 1.3 mm thickness. At 160 mm from the beginning the septum is 12 mm wide and approximately 300 micrometer thick. At the horn mouth the septum is 60 mm wide and approximately 300 micrometer thick. The horn there has width of 75 mm, height 50 mm.

An important aspect of the dielectric distribution is the effective 2 mm thickness of the 100 or 200 micrometer PTFE on the septum. Without this the 50 GHz frequency and 350 kV input signal and 1 GW power cannot be obtained.

Simply increasing the solid insulation or dielectric decreases maximum frequency and therefore must be limited.

The said dielectric material selection and technique conceived further applies to multi-septum HPM TEM-horns, single or duplicate half enclosure sections, and of various HPM TEM-horn shapes and sizes. The conceived dielectric and distribution herein to increase breakdown voltage with minimal decreases to the maximum frequency of operation facilitates the HPM TEM-horn's operation at 4 MV at 1 to 5 GHz.

Further improvements incorporated into the HPM TEM-horn design pertain to the input/output configuration 91 of FIG. 3B. The single input/output configuration of the "previous TEM-horn" design is further improved herein to 2-port or 4-port (multi-port) connectivity with a preferable right angle coaxial connectivity configuration 91 for generator connections to 2 or 4 septum HPM TEM-horns as shown in 306 of FIG. 3B.

It is further understood that other embodiments of the invention include optionally more than 4 generator connections as indicated in FIG. 3A and FIG. 3B with associated connectivity to various combinations of septums including 1, 2, 4, or more wherein each HPM TEM-horn septum may be powered by one or more generators.

With reference to FIG. 3C, a dielectric distribution cross-section is shown for a dual septum HPM TEM-horn which is similar to the dielectric distribution of multi-septum HPM TEM-horns. Further improvements incorporated into the advanced HPM TEM-horn design include high voltage tolerance to 4 MV at 1 to 5 GHz associated with an approximate 12 mm thick dielectric within the HPM TEM-horn enclosure metalized on the outside and extending from the power source end 322 where at the power source end the enclosure tapers to accommodate at least one septum covered with 100 or 200 micrometer thick PTFE coating that is extending toward the distal end of the HPM TEM-horn comprised of a mouth where radiation is emitted. It is understood that the radiation is launched from the septum significantly inside and 75% of the septum length away from the mouth of the HPM TEM-horn. The tapered shape of the HPM TEM-horn design realizes high dielectric and surface voltage breakdown, but also produces high frequency operation. The tapered shape applies to various enclosure embodiments including but not limited to conical, rectangular, trapezoidal, and pyramidal with the largest cross-section at the mouth and the smallest at the portal end of the enclosure.

Figure 3D:
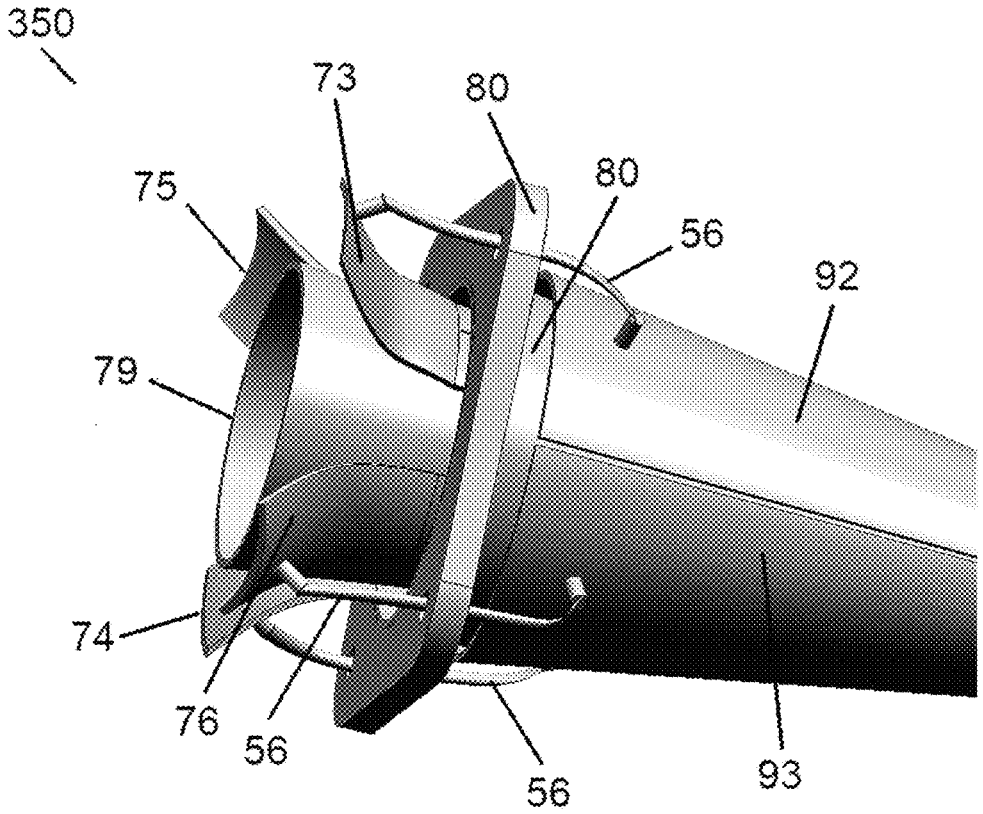
FIG. 3D is a pictorial view of a quad or multi-septum HPM TEM-horn with some of the primary components shown.

With reference to FIG. 3D, a pictorial view of a HPM TEM-horn 350 wherein non-obscured comprising components are identified. In this view four septums 76, 73, 74, and 75 of are identified. The only non-obscured termination resister 56 of four is identified. The horn enclosure metallization 92 is shown adjacent to the solid dielectric form 80. This is a double parts enclosure metallization formation including 93, but the joining lines are not visible in this view. A metalized enclosure 92/93 extends from the portal end to approximately the mouth of the HPM TEM-horn. The solid dielectric 79 is a plastic insulation on which the septums 352, 353 and 354 are resting and adjacent to. There are the 4 ribs not shown running along the entire length of the horn inside of 92 that hold the 2 solid dielectric plastic forms 79 and 80 in place and additionally provide high voltage insulation between the septums.

The invention teaches how to increase radiated power without increasing the energy by breaking down each primary interval (long) transmitting pulse currently used (by others) to multiple 1 ns primary generator pulses, T, each with a time spacing of T*Q (Quality factor of target oscillations) and T+T*Q comprising a primary interval, Tint, per bank of generators or in the case of a unitary bank size the primary interval would apply to each generator fired sequentially.

For example, firing 100 total generators segmented with a bank size of k=25 generators at a time with T*Q spacing between the different sub-groups or banks until all n*k=N=100 exemplary generators have fired. Transmitting four 2.5 MV/m, 1 ns long pulses inclusive with a time spacing of 5 ns would have an effective primary interval pulse duration of 20 ns, distractive E-field 35.7 times greater (2.5*10+6/7*10+4=35.7) and a damaging or burning force more than 6377 times greater ((20 ns/4 ns)*(35.7^2)=6377)) than the JOLT system.

The first of several triggering or firing scenarios is comprised of firing using a single pulse or master pulse provided with additional phasing control to all triggers of generators assures that all pulses have to arrive at the target at the same time. After calibration of the timing of the firing of individual generators has been completed, many other alternative automated firing sequences may be programmed or selected and coordinated by a fire control unit as a firing sequence. The fire control unit can control the triggering of each generator separately or by master pulses to sub-groups or banks triggered simultaneously. Banks of generators may each comprising 2 or more generators powering 1 or more TEM-horns.

The master sequence of firing is controlled by a visual or radar system that provides information about what type of target, size of target, the approach trajectory of the target, and the best point of engagement or radiation contact.

Figure 4:
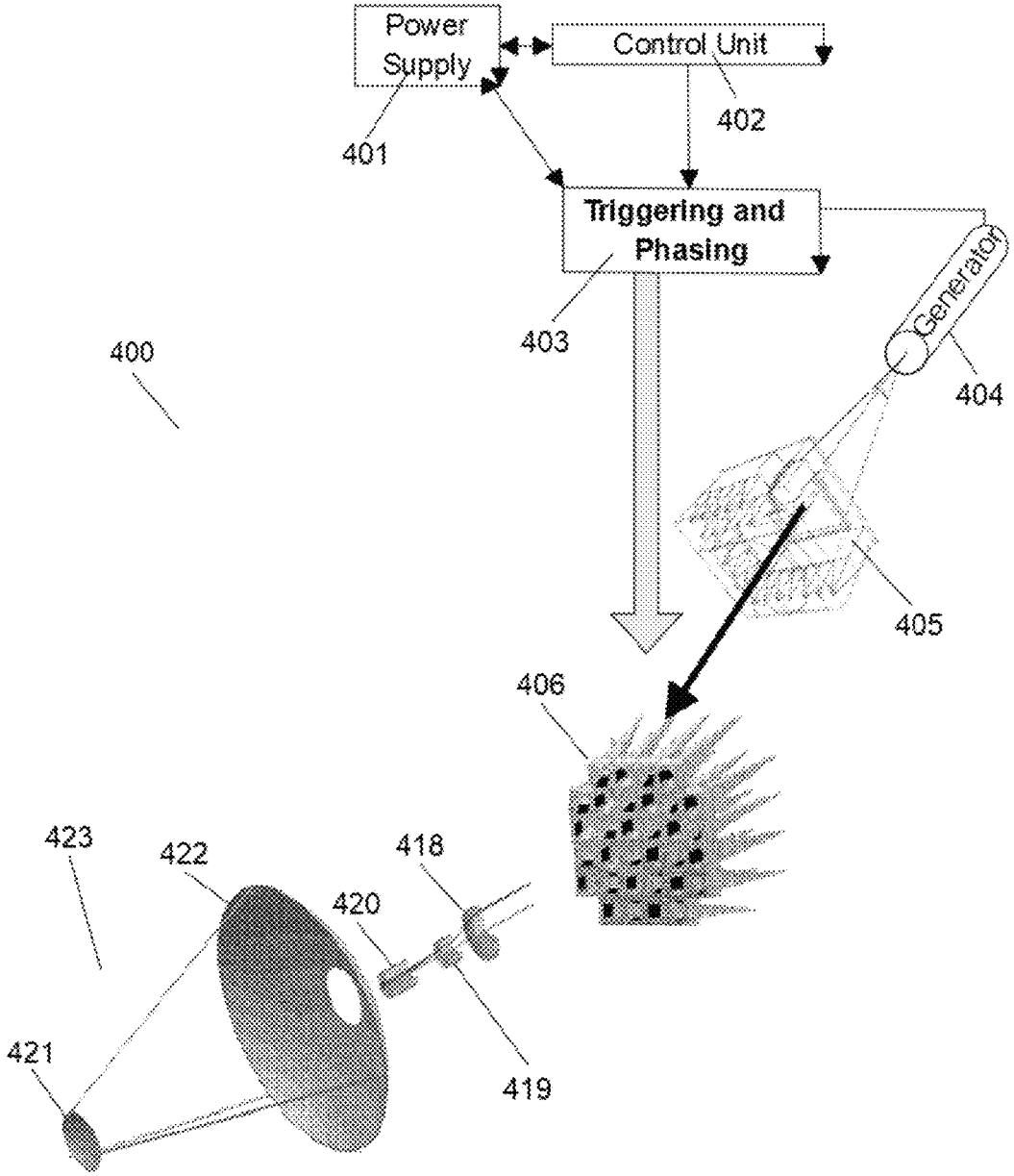
FIG. 4 is an assembly diagram of the primary components of the weapon system radiating source apparatus.

With reference to FIG. 4, an exemplary high power microwave weapon system radiation source 400 is shown including various required and optional components. A power supply 401 provides power to a triggering and phasing circuit 403. A control unit 402 monitors the power supply and initiates triggering circuitry 403 for generating radiation. The triggering and phasing circuitry 403 with phase shifters between each HV generator and trigger pulses for typical generator 404 to generate high power microwave radiation. Typical generator 404 provides radiation to typical HPM TEM-horn 405. An array 406 of HPM TEM-horns is populated by the typical HPM TEM-horns 405. An optional lens set 418, 419, and 420 includes at least one Barlow lens. A Cassegrain antenna 423 includes a secondary reflector 421 that reflects radiation from the HPM TEM-horns to the Cassegrain primary reflector 422 which reflects the radiation from the secondary reflector outward away from the radiation source 400.

The manufacturing and assembly of all of these and other components is optimized by having all HPM TEM-horns 405/406 made out of metalized plastic and each horizontal row of HPM TEM-horns 406 resting on an arc. Attaching an exemplary six arcs into a single frame or module facilitates an efficient assembly process and positioning of HPM TEM-horns 406. Each typical HPM TEM-horn 405 diameter is very small at the generator input. The phasing, trigger circuits, and generators triggers are optionally assembled locally at TEM-horn 406 antenna inputs.

Figure 5:
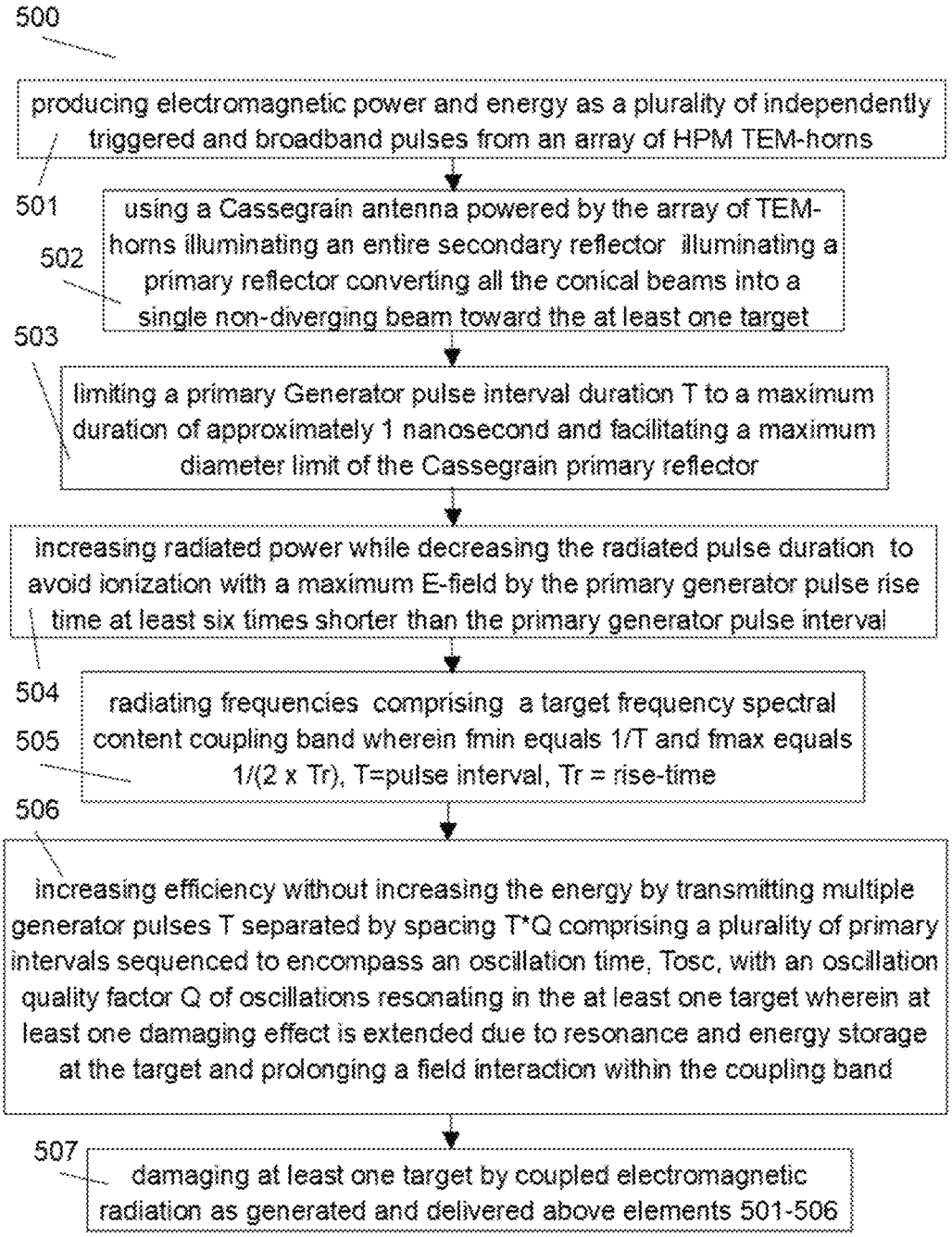
FIG. 5 is a flow diagram of a method for high power high efficiency microwave radiation generation, transmission, and damaging effects of the weapon system.

With reference to FIG. 5, a flow diagram 500 showing a plurality of method elements of this invention is shown starting with 501 disclosed as; producing electromagnetic power and energy as a plurality of independently triggered and broadband pulses from an array of TEM-horns. The following element 502 is disclosed as; using a Cassegrain antenna powered by the array of TEM-horns illuminating an entire secondary reflector illuminating a primary reflector converting all the conical beams into a single non-diverging beam toward the at least one target. The following element 503 is disclosed as; limiting a primary pulse interval duration T to a maximum duration of approximately 1 nanosecond and facilitating a maximum diameter limit of the Cassegrain primary reflector. The following element 504 is disclosed as; increasing radiated power while decreasing the primary generator radiated pulse duration to avoid ionization with a maximum E-field by a pulse rise time at least six times shorter than the primary generator pulse interval. The following element 505 is disclosed as; radiating frequencies comprising a target frequency spectral content coupling band wherein fmin equals 1/T and fmax equals 1/(2×Tr), T=generator pulse time, Tr=rise-time of T. The following element 506 is disclosed as; increasing efficiency without increasing the energy by transmitting multiple generator pulses T separated by spacing T*Q comprising a plurality of primary intervals sequenced to encompass an oscillation time, Tosc, with an oscillation quality factor Q of oscillations resonating in the at least one target wherein at least one damaging effect is extended due to resonance and energy storage at the target and prolonging a field interaction within the coupling band.

The following element 507 is disclosed as; damaging at least one target by coupled electromagnetic radiation as generated and delivered above elements 501-506. It is to be understood that the method elements disclosed herein disclose only one of many possible methods supported by the disclosure. It is also to be understood that the disclosed method may be performed in various equivalent sequences including some of the method steps or elements may be performed simultaneously or in various alternate orders.

Spectroscopic, transfer functions, relate spectral content to spectral components: with a radiation interval or primary generator pulse time T of approximately 1 nanosecond (1 ns=$10^{-9}$ seconds), the minimum frequency fmin corresponds to 1 GHz minimum radiation frequency. The primary generator time pulse length corresponds to T=1/fmin, where fmin corresponds to the minimum frequency of the highest electromagnetic wave coupling band, assures the most efficient electromagnetic field coupling and optimal power and energy transfer from the radiation.

The 1 ns primary generator pulse duration T corresponding to 1 GHz, defines and determines the geometry of the HPM TEM-horn and the Cassegrain antenna. As a practical consideration of Cassegrain antenna size, the 1 ns primary generator pulse duration translates to a Cassegrain antenna diameter of approximately 9 meters which is a practical size for most HPM weaponry applications.

An important aspect of this invention is keeping the timing of the shorter generator pulses including spacing thereof proportional to the oscillation quality factor Q of the electromagnetic interaction and inversely proportional to the target oscillation frequency fosc that results in an apparent increase of energy at the target without using any power from the power supplies: Tosc=Q/fosc.

Figure 6A:
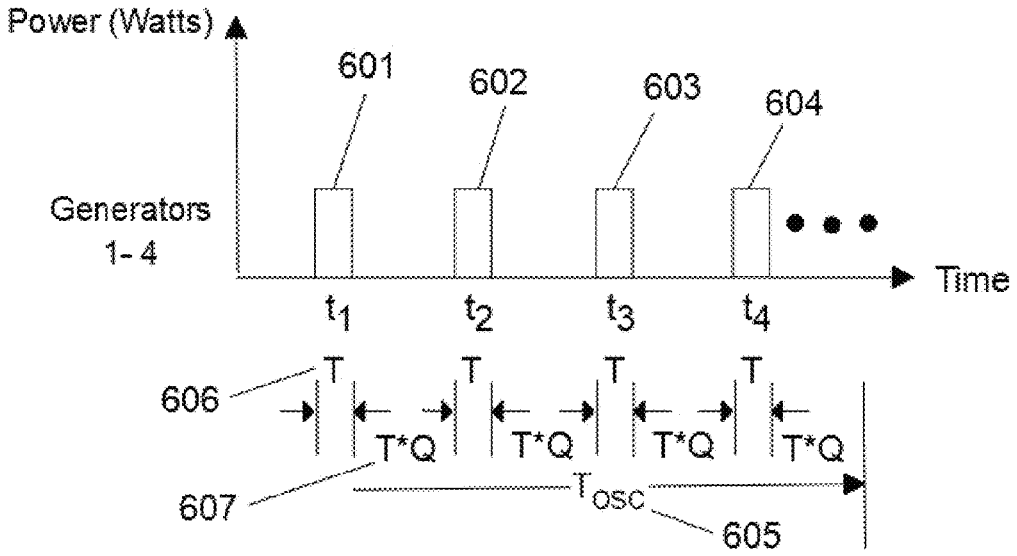
FIG. 6A is a timing diagram with time on the abscissa axis and time on the ordinate axis showing generator pulses T with separations T*Q wherein generators are fired in single file with a bank size of one.

With reference to FIG. 6A, a plurality of sequential pulses 601, 602, 603, 604, or ($t_1$, $t_2$, $t_3$, $t_4$), where 4 is the number of exemplary generators as shown being fired sequentially. In this case, the Bank size k is only 1 generator each. Each primary generator pulse T 606 is shown separated by a time spacing of T*Q 607 comprising a combined time (T+T*Q) or T(1+Q) corresponding to a primary interval duration Tint. An oscillation time 605, Tosc, of the target requires some number of primary intervals to conclude a firing sequence, and this case, the number of primary intervals required exceeds 4 as indicated in FIG. 6A.

Compared with the typical target total oscillation time, Tosc 605, the sequential primary generator pulses T 606, being shorter and sequentially distributed with interposing time spacing T*Q 607 comprising primary intervals, Tint=T+T*Q, sequentially encompassing the Tosc time period 605, increases the power without increasing the transmitted energy. Furthermore, almost all complex target systems store the energy of the field prolonging the field interaction and extending the damage based on the oscillation quality factor Q.

It is understood that for a typical Tosc 605 time, a plurality of generators must be fired accordingly in sequential primary intervals to encompass, match, or align with the Tosc 605 requirement. It is not untypical to require generators to be combined as banks in order to satisfy the Tosc 605 requirement. It is further understood that each HPM TEM-horn can be powered by a plurality of generators with one or a plurality of generators per septum.

Figure 6B:
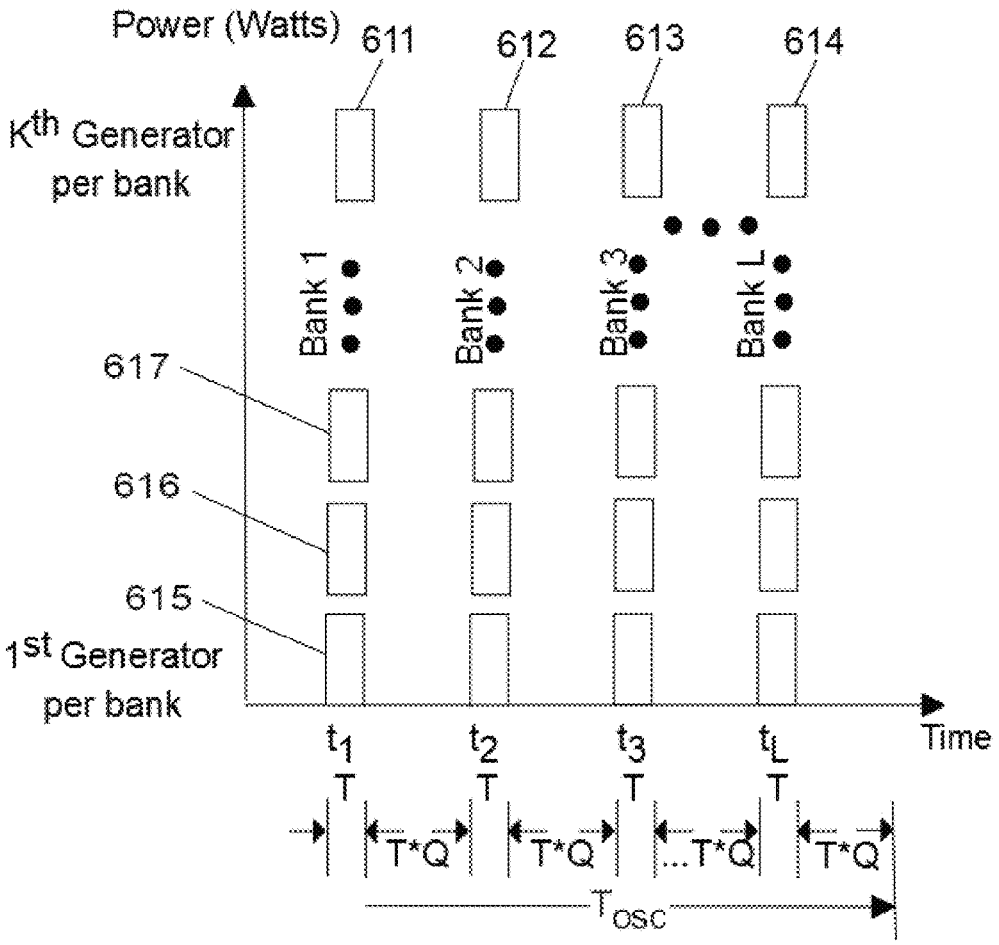
FIG. 6B is a timing diagram with time on the abscissa axis and time on the ordinate axis showing generator pulses T with separations T*Q wherein the generators are grouped into L banks of k generators each.

With reference to FIG. 6B, a plurality of sequential and parallel generator pulses is shown at times ($t_1$, $t_2$, $t_3$, . . . , $t_L$), where L is the number of banks of generators), associated with triggering said banks of at least one generator in each bank or sub-grouping, with time spacing T*Q between each of the primary generator pulses ($t_1$, $t_2$, $t_3$, $t_L$) of triggered radiation. The primary interval Tint is (T+T*Q) or T(1+Q) in duration. A typical target oscillation time Tosc=L*T(1+Q) wherein L banks of generators are fired in sequential T(1+Q) primary intervals in order to satisfy the Tosc 605 requirement.

With continued reference to FIG. 6B, at each primary generator pulse time $t_i$, multiple generators (k) are fired approximately simultaneously as indicated by first generator 615, second generator 616, third generator 617, and kth generator 611 for generator pulse T 606 time $t_1$ with spacing T*Q 607 as applied to FIG. 6B for example timing pertaining to Bank 1. Similar near simultaneous bank firings occur at $t_2$ for Bank 2 generators 612, $t_3$ for Bank 3 generators 613, and $t_L$ for Bank L generators 614.

Figure 7A:
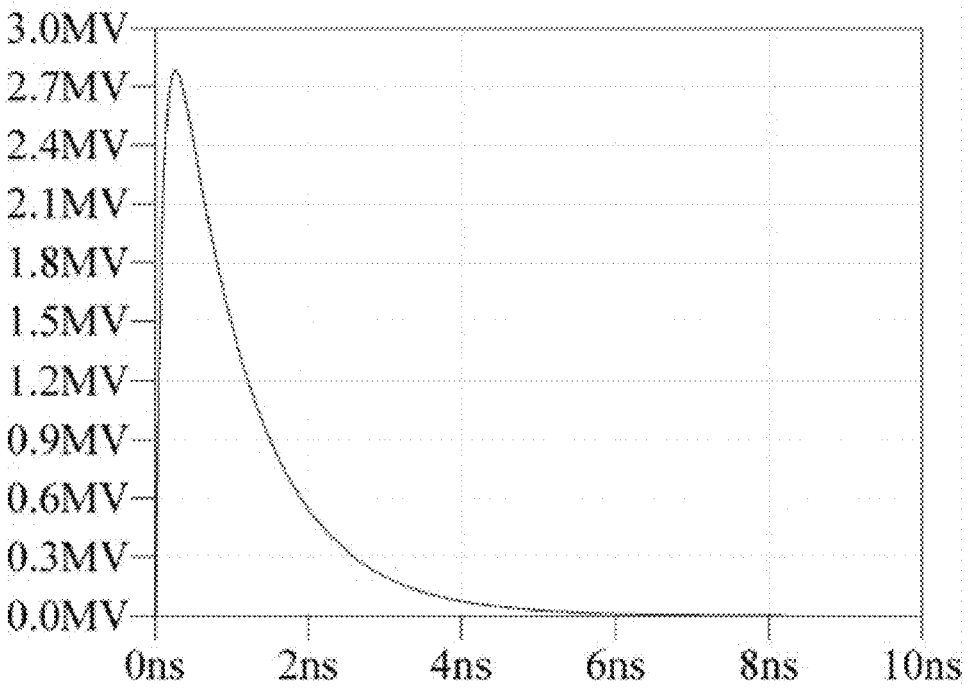
FIG. 7A is a plot of a generated voltage as applied to a model of an electromagnetic HPM interaction using SPICE.
Figure 7B:
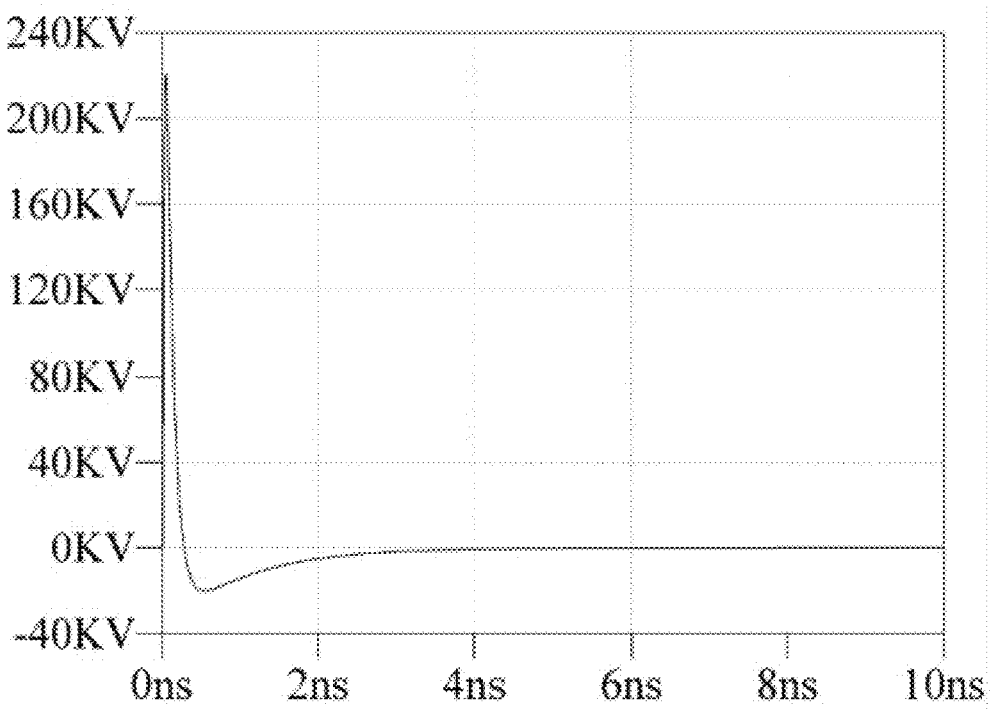
FIG. 7B is an E-field plot that represents the radiated E-field from the high power weapon system antenna.
Figure 7C:
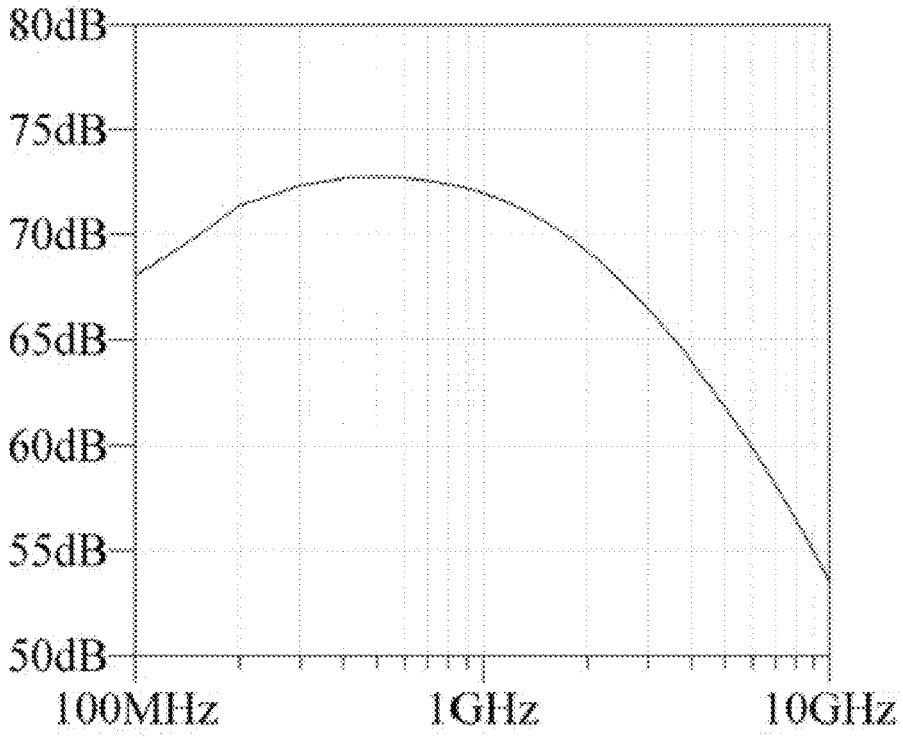
FIG. 7C is a fast Fourier transform (FFT) of the plot of FIG. 7B, showing how the wideband of generated and radiated power is responsible for increasing the probability of target destruction or damage, by application of a single pulse, providing power to engage the target at wideband frequencies.
Figure 7D:
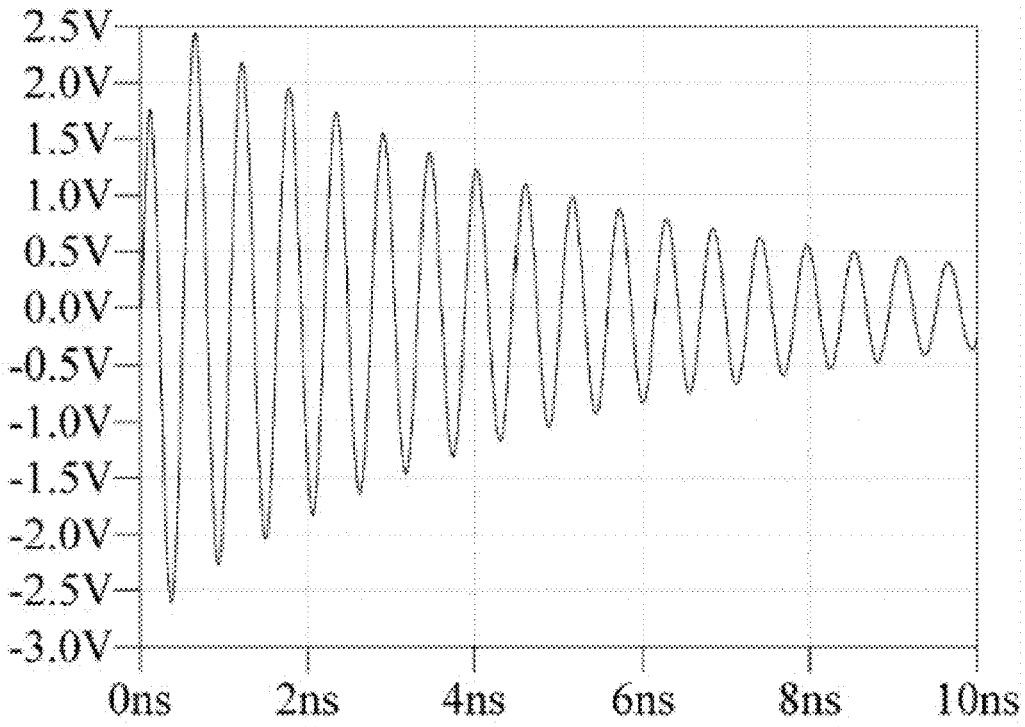
FIG. 7D is a plot of an electromagnetic E-field reverberating within a simulated target electronic system and coupling into the most sensitive component of the target.
Figure 7E:
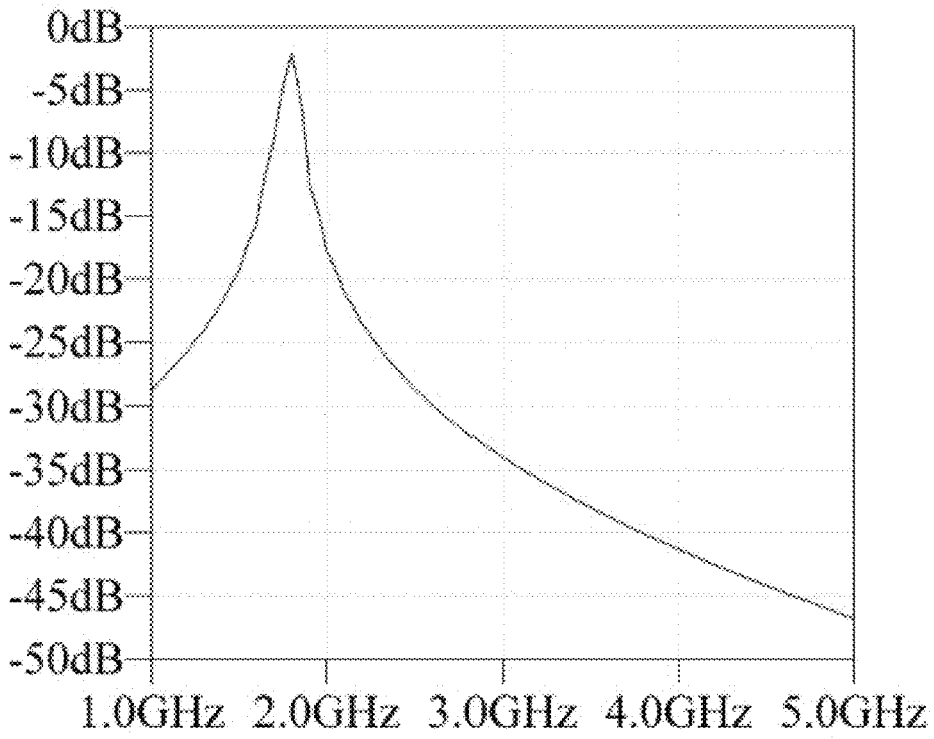
FIG. 7E is a fast Fourier transform (FFT) of the plot in FIG. 7D, showing how the narrowband power coupling is responsible for increasing the pulse duration—a resonance at only one frequency, approximately 1.8 GHz is shown.
Figure 7F:
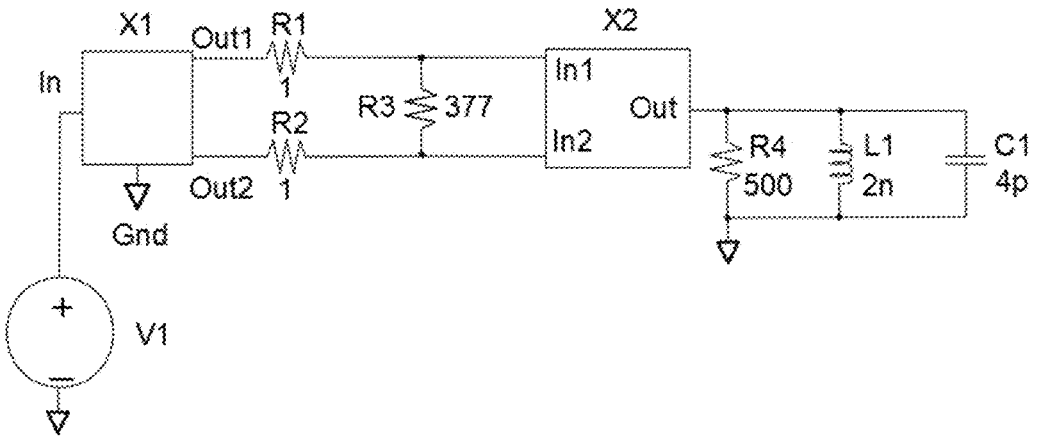
FIG. 7F is a circuit diagram of the SPICE model of an electromagnetic HPM and the target interaction.

With reference to FIGS. 7A-7F, beginning with FIG. 7F, an interaction model of an HPM system operating in the 1 to 5 GHz band consists of a pulse generator V1 providing a double-exponential pulse having rise-time of 100 ps and duration of 1 ns as shown in FIG. 7A to an antenna represented by sub-circuit X1 in FIG. 7F. Circuit X1 is a differentiating circuit that converts a single input, to accommodate the generator, to a double output that is needed to assure independence in respect to the ground antenna radiation beam. The 377 ohm resistor R3 in FIG. 7F simulates the free space impedance of the air. Resistor R3 although in reality is symmetrical to the ground, in SPICE it has to be at one end connected to the ground. The voltage on the resistor R3 is presented in the "E-field" FIG. 7B and it corresponds to the E-field radiated from the antenna. Circuit X2 in FIG. 7 is a capacitive divider that represents a hole through which the radiated E-field penetrates a simulated target enclosure. Circuit X2 converts the double input of the independent in respect to the ground beam of radiation, to a single output to accommodate a partially opened metal enclosure containing a wire grounded with resistor R4 on only one end. The output voltage delivered to the most sensitive components of the target is measured on the resistor R4 and it is represented by graph of FIG. 7D. What is shown in the graph of FIG. 7D is a reverberating in the box electromagnetic E-field coupled to wire terminated to a ground on only one end with the other end of the wire floating. This is a most common representation of the EM coupling into electronics. FIG. 7E represents a frequency domain graph of FIG. 7D. FIG. 7E shows how the different frequencies of the electromagnetic field components are coupling to the target. The radiated E-field components of FIG. 7E show a resonance at only one frequency—approx. 1.8 GHz. Normally there are more resonances in the frequency band of interest since at microwave frequencies (short wavelengths) all dimensions of average boxes and cables are few times longer than half-wavelength.

FIG. 7B-7E are displaying the time and frequency plots of the generated/radiated pulse and the pulse coupled into the target. The plots show how the wideband generated and radiated power is responsible for increasing the probability of target destruction by allowing during application of a single pulse, excitation of narrowband frequencies in a wideband frequency window of 1 to 5 GHz. Specifically the plots show how the narrowband coupling of power presented by FIG. 7E is responsible for increasing the pulse duration in the target shown in FIG. 7D. Considering the displayed results to increase the peak power and to decrease the energy usage, the generated and radiated pulse has to be as short as possible and the pulse at the target has to be as long as possible, a primary aspect of this invention.

As an explanation and example of a bank firing algorithm with primary generator time T=1 ns and for N=100 generators total and a target oscillation quality factor of 5: for 4 sub-groups or banks of generators wherein each bank $b_i$ (i=1, 2, 3, 4) has k=25 generators fired at until all N=100 generators have fired. The triggering periods for firing the banks of generators are 6 ns with the exemplary Q=5, resulting in a total oscillation time of 24 ns and providing energy for only 4 ns.

To damage a target with the lowest energy we have to approach the highest electromagnetic coupling band from the highest frequencies i.e. shortest pulse duration. If at frequencies higher than the highest electromagnetic coupling band the target could be damaged, these frequencies should be considered wherein fmin corresponds to the minimum frequency of the highest electromagnetic wave coupling band. This may not assure the most efficient electromagnetic field coupling and not near-perfect power transfer, but it assures a perfect energy transfer. i.e. if shorter pulse with less energy will damage the target, there is no need to make the pulse longer, use more energy, and build larger more powerful equipment.

An embodiment of the current invention (ASR System) is presented herein along with a comparable analysis of the JOLT system design (JOLT) having an E-field*R=$6\times10^{+6}$ V and a dish antenna diameter, $D_1$=3.6 meters vs. the ASR Cassegrain antenna having a diameter, $D_2$=9 meters. The following disclosure represents a constructive reduction to practice of the invention and provides a real world basis for comparing the capability of the invention against the performance of a comparable embodiment of an existing inferior weapon system called "JOLT." The exemplary weapon system of the invention is called "ASR."

To avoid the effects of different illumination area of the JOLT and ASR analyzed systems, the energy available at the target is related to the effective radiated E-field available at one square meter (1 $m^2$) of the target area.

Calculation of gain/loss of energy in HPM weapons such as JOLT and ASR is done assuming no loss in the power supply i.e. the energy and power of the radiated pulse is related to the peak voltage of the generator and a proper termination resistance of the antenna.

The comparison begins by summarizing the calculated and disclosed results of JOLT as follows:

$V_{g1}=10^{+6}$ V — Generated voltage:

$T_1=4*10^{-9}$s — Radiated Pulse duration:

$t_1=1*10^{-9}$s — Effective pulse duration:

$R_{g1}$=86 ohm — Antenna Input Impedance:

$D_1$=3.6 m — Diameter of the radiating antenna dish:

Area of Beam Illumination:

$$S_1 = \frac{\pi}{4}D^2 = 10.2\ \text{m}^2$$

$F_1$=70 kV/m — Strength of the E-field:

Power from the Generator:

$$P_{g1} = \frac{V_{g1}^2}{2*R_{g1}} = 5.8*10^{+9}\ \text{W}$$

$E_{g1}=P_{g1}*T_1$=23.26 J(Watt*second) — Energy from the generator:

Power Contained in a Pulse Illuminating One $m^2$ of Target Area:

$$P_{S1}\left(\frac{W}{m^2}\right) = \frac{2F^2}{Z_0} = 2\frac{(7*10^{+4})^2}{377} = 26\ \text{MW/m}^2$$

$E_{r1}=P_{s1}*t_1$=0.026 J/$m^2$ — Energy contained in a pulse illuminating one $m^2$ target area:

$E_{e1}=E_{r1}/E_{g1}$=0.0011=0.1% — Energy efficiency:

The calculated or analyzed results for the ASR embodiment of the current invention with an HPM TEM-horn array is summarized as follows:

$N_{g2}$=32 — Number of generators in the array (only one generator per one TEM-horn):

$V_{g2}=4*10^{+6}$ V — Generated voltage per one generator:

$T_2=1*10^{-9}$ s — Radiated Pulse duration:

$t_2=1*10^{-9}$ s — Effective pulse duration:

$R_{g2}$=100 ohm — Antenna Input Impedance:

$D_2$=9 m — Diameter of the radiating antenna dish:

$S_2=\pi/4D^2$=63.6 $m^2$ — Area of beam illumination:

$F_2$=3 MV/m — Strength of the E-field:

Power from the $N_{g2}$ Generators:

$$P_{g2} = N_{g2}\frac{V_{g2}^2}{2*R_{g2}} = 1.28*10^{+12}\ \text{W}$$

$E_{g2}=P_{g2}*T_2$=1.28 k J (kWatt*second) — Energy from $N_{g2}$ generators:

Power Contained in a Pulse Illuminating One $m^2$ of Target Area:

$$P_{S2}\left(\frac{W}{m^2}\right) = \frac{2F^2}{Z_0} = 2\frac{(3*10^{+6})^2}{377} = 47.7\ \text{GW/m}^2$$

$E_{r2}=P_{s2}*t_2=47.7\ \text{J/m}^2$ Energy contained in a pulse illuminating one $m^2$ target area:

$E_{e2}=E_{r2}/E_{g2}=0.037=3.7\%$ Energy efficiency:

The most important comparisons of the JOLT and ASR systems pertain to the strengths of the radiated E-field and efficiencies.

The ASR system's Cassegrain antenna has a diameter of 9 m and radiates E-field of 3 MV/m. Comparisons of this invention with the JOLT system include; JOLT system diameter of 3.6 m and a radiated E-field of 70 kV/m includes a 9/3.6=2.5 antenna diameter factor which is relatively small in respect to the strength of E-field (kV/m) ratio; 3000/70=43.

The increase of energy efficiency between the ASR and JOLT systems is 11: $\eta=E_{e2}/E_{e1}=33.6=3360\%$. The increased efficiency allows an ASR system to be facilitated using a much smaller power supply with less bulk and weight for mobility.

Another exemplary system of the invention may include but is not limited to 32 HPM TEM-horns (i.e. 6*6 array minus 4 HPM TEM-horns in the 4 corners), each with a single generator to illuminate the Cassegrain antenna. If such arrangement is used as a receiver, 32 HPM TEM-horns each having 4 outputs will have in a single Cassegrain antenna 128 outputs. Considering that out of the 128 outputs half consists of +/−voltage, providing 64 outputs consisting of double voltages.

The received signals could be processed in time and frequency (by dividing the entire spectrum into small bands) offering information bandwidth never achieved before—for example fmax/fmin=100. Because there is essentially no high power limitation, an antenna operating from 1 to 50 GHz is conceived. It is considerable that one Cassegrain antenna could have 32 antennas [64 outputs and 10 (5 GHz each) bands] for video, one could process 640 video channels in parallel. At maximum frequencies of 500 GHz, the 32 channels when delayed in time could allow measuring real time femtosecond (fs=$10^{-15}$ second) signals. A single Cassegrain antenna would allow measuring single physical phenomena at the fs time scale. Using multiple Cassegrain antennas allows not only time, but also 3D spatial studies. All of this is done from a distance, and none of this has ever been possible prior to this invention.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method for damaging at least one target by coupled electromagnetic radiation directed and transmitted to an at least one target from a microwave weapon system producing electromagnetic power and energy comprising:

producing a plurality of independently triggered broadband electromagnetic pulses from an array of HPM TEM-horns, each HPM TEM-horn powered by at least one generator;

transmitting the pulses to a Cassegrain antenna, where the pulses illuminate an entire secondary reflector of the Cassegrain antenna, where after reflection from the secondary reflector, conical beams of the pulses illuminate a primary reflector, which converts all the conical beams into a single non-diverging beam toward the at least one target;

limiting a primary generator pulse interval duration T to a maximum duration of 1 nanosecond, where a maximum diameter of the Cassegrain primary reflector is 9 meters;

increasing radiated power while decreasing the radiated primary generator pulse duration of the conical beams to avoid ionization with a maximum E-field for increased power that is achieved by the primary generator pulse rise-time at least six times shorter than the primary generator pulse interval duration;

radiating frequencies comprising a target frequency spectral content coupling band from frequency fmin to frequency fmax most susceptible to electromagnetic radiation based on the primary generator pulse interval T and rise-time Tr wherein fmin equals 1/T and fmax equals 1/(2×Tr); and increasing efficiency without increasing the energy by transmitting multiple generator pulses T separated in time by spacing T*Q comprising a plurality of primary intervals sequenced to encompass an oscillation time Tosc with an oscillation quality factor Q of oscillations resonating in the at least one target wherein at least one damaging effect is extended due to resonance and energy storage at the target and prolonging a field interaction within the coupling band.

2. The method of claim 1, the damaging further comprising at least one of destroying the target and rendering the target inoperable.

3. The method of claim 1 further comprising triggering banks of sub-groupings of generators sequentially during the oscillation time Tosc.

4. The method of claim 3 further comprising triggering a total number of generators available for the electromagnetic radiation by sequentially triggering the banks of generators.

5. The method of claim 1 further comprising setting fmax/fmin to be greater than 3.

6. The method of claim 1 wherein the array of HPM TEM-horns is in a concave or flat configuration.

7. The method of claim 1 further comprising transmitting the radiation from the HPM TEM-horn array through a lens set as it proceeds to the Cassegrain secondary reflector.

8. The method of claim 7 wherein the lens set is comprised of at least one Barlow lens.

9. The method of claim 1 further comprising inflicting at a E-field level of MV/m, molecular, heat induced, or and combined molecular and heat induced damaging effects by a distance from the Cassegrain antenna up to a maximum beam non-diverging distance $$R_\lambda \approx \frac{D_\lambda^2\sqrt{\lambda}}{2}$$

corresponding to the Cassegrain antenna primary reflector diameter $$D_\lambda \approx \frac{115}{\sqrt{\pi}}$$

expressed in wavelengths at a central frequency fc, wherein $$fc = \sqrt{f\min \times f\max}.$$

10. The method of claim 1 wherein the Cassegrain antenna is powered by a concave face assembly of the multiple conical beams illuminating the entire secondary reflector of the Cassegrain antenna to sustain a maximum target distance up to the square of the Cassegrain antenna primary reflector diameter multiplied by a factor of at least one hundred.

11. The method claim of claim 1 wherein using the Cassegrain antenna powered by the concave or flat face assembly of a plurality of the conical beams illuminating a set of lenses including at least one Barlow lens that reduces the angular illumination of the entire secondary reflector of the Cassegrain antenna, that after reflection from the secondary reflector illuminate a primary reflector.

12. The method claim of claim 11 further comprising converting all the conical beams into a single non-diverging beam that comprises uniformly distributed power of all pulses in the single beam unaffected by beam non-diverging distance $$R_\lambda \approx D_\lambda^2 \sqrt{\lambda} / 2$$

corresponding to the Cassegrain antenna primary reflector diameter $$D_\lambda \approx \frac{115}{\sqrt{\pi}}$$

expressed in wavelengths at a central frequency fc, multiplied by the angular amplification of the Barlow lenses, wherein $$fc = \sqrt{f\min \times f\max}.$$

13. The method of claim 1 wherein assembling a plurality of Cassegrain antennas comprising HPM TEM-horns with coordinated triggers and focused at a single target location point, each powered by a concave face assembly of multiple conical beams transmitted to the focusing point resulting in a GV/m E-field required to induce non-linear atomic interactions.

14. A high power microwave weapon system comprising:

at least one power supply configured to power microwave radiation generators;

a control unit configured to control timing and firing sequences as triggers to an at least one radiation generator through triggering and phasing circuitry;

the triggering and phasing circuitry configured to simultaneous fire the microwave radiation generators in at least one bank of generators repeated as a sequence of primary intervals powering an at least one HPM TEM-horn per generator;

the microwave radiation generators configured to increase power and efficiency without increasing the energy by transmitting sequential primary intervals comprised of generator pulses T equal to 1 ns separated by spacing T*Q encompassing an oscillation time Tosc with an oscillation quality factor Q of oscillations for causing resonances in the at least one target wherein at least one damaging effect is extended due to the resonance and energy storage at an at least one target and prolonging a field interaction within the coupling band of the at least one target;

the at least one HPM TEM-horn further comprising an array of HPM TEM-horns radiating onto a secondary reflector of a Cassegrain antenna;

the at least one HPM TEM-horn further comprising at least one array of HPM TEM-horns wherein the at least one array of HPM TEM-horns are designated as at least one bank of HPM TEM-horns;

the secondary reflector of the Cassegrain antenna configured to illuminate radiation from the at least one HPM TEM-horn array onto a primary reflector of a Cassegrain antenna;

the primary reflector of the Cassegrain antenna comprising a diameter of 9 meters corresponding to a 1 ns generator pulse time T;

the primary reflector of the Cassegrain antenna further configured to receive radiation from the secondary reflector of the Cassegrain antenna and redirect the radiation as a radiation beam emitted from the Cassegrain antenna;

the radiation beam emitted from the Cassegrain antenna is comprised of a non-diverging section with a maximum length of RX, and a diverging section which begins at the distal end of the non-diverging section;

the radiation beam emitted from the Cassegrain antenna is further comprised of a non-interrupted elongation of the beam until the first of the non-diverging section or diverging section interacts with the at least one target;

the at least one target interaction of the radiation beam providing a coupled energy into the at least one target according to the target coupling band;

the target coupling band of the at least one target interaction is comprised of a fmin to fmax range wherein a center frequency of the coupling band is determined by $$fc = \sqrt{f\min \times f\max}$$

and fmin is 1/T and fmax is 1/(2×Tr) with a rise-time of the generator pulse, Tr≈T/6; and the coupled energy of the at least one target interaction comprises a target damage wherein at least one damaging effect is extended due to resonance and energy storage within the target resulting from at least one primary interval of radiation coupled to the target and prolonging a field interaction within the coupling band.

15. The system of claim 14 further comprised of at least one Barlow lens set mounted between the at least one HPM TEM-horn array and the secondary reflector of the Cassegrain antenna.

16. The system of claim 14 further comprised of the at least one HPM TEM-horn array further comprising an optimum number of HPM TEM-horns $$N_{opt} \lessapprox \frac{\pi}{350} D_\lambda^2$$

of the array with a $$D_\lambda \approx \frac{115}{\sqrt{\pi}}$$

primary reflector ammeter expressed in wavelengths corresponding to the center frequency fc of a coupling band wherein $$fc = \sqrt{f\min \times f\max},$$

and said HPM TEM-horn array illuminating a secondary reflector of a Cassegrain antenna.

* * * * *